US008926042B2

(12) United States Patent
Ono et al.

(10) Patent No.: US 8,926,042 B2
(45) Date of Patent: Jan. 6, 2015

(54) PULSE GENERATOR

(71) Applicants: Kabushiki Kaisha Toshiba, Tokyo (JP); Toshiba Tec Kabushiki Kaisha, Tokyo (JP)

(72) Inventors: Shunichi Ono, Shizuoka-ken (JP); Teruyuki Hiyoshi, Shizuoka-ken (JP); Mamoru Kimura

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,265

(22) Filed: Dec. 9, 2013

(65) Prior Publication Data

US 2014/0160195 A1 Jun. 12, 2014

(30) Foreign Application Priority Data

Dec. 11, 2012 (JP) ..... 2012-270450

(51) Int. Cl.
*B41J 29/38* (2006.01)
*B41J 2/045* (2006.01)

(52) U.S. Cl.
CPC ..... *B41J 2/04588* (2013.01)
USPC ..... 347/10; 347/69

(58) Field of Classification Search
CPC .. B41J 2/04541; B41J 2/0455; B41J 2/04581; B41J 2/04588; B41J 2/14209
USPC ..... 347/9–11, 68–72
See application file for complete search history.

(56) References Cited

U.S. PATENT DOCUMENTS

| | | | | |
|---|---|---|---|---|
| 6,437,964 | B1 * | 8/2002 | Takamura et al. | 361/235 |
| 6,773,085 | B2 * | 8/2004 | Sakuma | 347/11 |
| 6,841,920 | B2 | 1/2005 | Takamura et al. | |
| 8,622,497 | B2 * | 1/2014 | Hiyoshi et al. | 347/9 |

FOREIGN PATENT DOCUMENTS

| | | |
|---|---|---|
| JP | 09-254412 | 9/1997 |

* cited by examiner

*Primary Examiner* — An Do
(74) *Attorney, Agent, or Firm* — Amin, Turocy & Watson, LLP

(57) ABSTRACT

A pulse generator forms, from setting data respectively stored in an ejection relevant waveform setting register and a first high impedance setting register, an ejection relevant driving pulse for setting an electrode of an ink chamber communicating with an ejection relevant nozzle to a high impedance state for a predetermined period. The pulse generator forms, from setting data respectively stored in an ejection both-side waveform setting register and a second high impedance setting register, an ejection both-side driving pulse for setting electrodes of ink chambers communicating with ejection both-side nozzles to the high impedance state for the predetermined period. The pulse generator outputs signals of the formed driving pulses to an inkjet head.

9 Claims, 17 Drawing Sheets

500

| Hi-Z DESIGNATION | POTENTIAL CODE | G | PV | MV | LV CON | No.x |
|---|---|---|---|---|---|---|
| 0 | 00 | 1 | 0 | 0 | 0 | VSS |
| 0 | 01 | 0 | 1 | 0 | 0 | +VAA |
| 0 | 10 | 0 | 0 | 1 | 0 | -VAA |
| 0 | 11 | 0 | 0 | 0 | 1 | LVCON |
| 1 | — | 0 | 0 | 0 | 0 | Hi-Z |

PULSE GENERATOR

CROSS-REFERENCE TO RELATED APPLICATION

This application is based upon and claims the benefit of priority from Japanese Patent Application No. 2012-270450, filed Dec. 11, 2012, the entire contents of which are incorporated herein by reference.

FIELD

Embodiments described herein relate generally to a pulse generator that generates a driving pulse signal for an inkjet head.

BACKGROUND

As an inkjet head, there is a type in which an ink chamber shares an actuator with an ink chamber adjacent to the ink chamber. Such an inkjet head is called a share mode type. In the inkjet head of the share mode type, a plurality of ink chambers partitioned by partition walls made of a piezoelectric material are provided side by side. Electrodes are respectively disposed on the wall surfaces of the ink chambers. Therefore, from an electrical point of view, the inkjet head is equivalent to a series circuit of capacitors.

In such a circuit, stray capacitance is generated between the capacitors connected in series. The stray capacitance is charged or discharged when voltages of the same potential are simultaneously applied to both ends across the capacitors. A noise current is generated in the head according to the charging or the discharging of the stray capacitance. Electric power is uselessly consumed. Such a problem is solved by opening at least one end of the capacitors to a high impedance state.

In the case of the inkjet head of the share mode type, voltages of driving pulses are applied to the electrodes of the ink chambers. Waveforms of the driving pulses are different in a pulse applied to the electrode of the ink chamber communicating with a nozzle that ejects ink and a pulse applied to the electrode of the ink chamber communicating with a nozzle that does not eject ink. However, it could often occur that voltages of the same potential are simultaneously applied to the electrodes of two ink chambers provided side by side across the partition wall.

Therefore, when the voltages of the same potential are simultaneously applied to the electrodes of the two ink chambers, it is conceivable to suppress the noise and the useless power consumption due to the stray capacitance by setting the electrode of one ink chamber to the high impedance state at appropriate timing.

The driving pulses respectively applied to the electrodes disposed in the ink chambers of the inkjet head are generated by a pulse generator (a pattern generator) and output to the inkjet head. Therefore, in order to suppress the noise and the useless power consumption due to the stray capacitance, there is a demand for a generator of driving pulses that can set the electrodes to the high impedance state at appropriate timing.

DETAILED DESCRIPTION

In an embodiment, a pulse generator generates a driving pulse applied to an electrode of an inkjet head. The inkjet head is a share mode type in which electrodes are respectively disposed on the wall surfaces of a plurality of ink chambers provided side by side while being partitioned by partition walls made of a piezoelectric material, a potential difference is applied to the electrodes of adjacent two ink chambers to deform the partition wall sandwiched by the electrodes, and ink is ejected from a nozzle communicating with the ink chamber including the deformed partition wall as the wall surface.

The pulse generator includes an ejection relevant waveform setting register, an ejection both-side waveform setting register, a first high impedance setting register, a second high impedance setting register, a wave form forming unit, and an output unit.

The ejection relevant waveform setting register stores setting data of an ejection relevant driving pulse applied to the electrode of the ink chamber communicating with, among the nozzles, an ejection relevant nozzle that ejects the ink. The ejection both-side waveform setting register stores setting data of an ejection both-side driving pulse applied to the electrodes of the ink chambers communicating with, among the nozzles, ejection both-side nozzles arranged on both sides of the ejection relevant nozzle. The first high impedance setting register is provided to correspond to the ejection relevant waveform setting register and stores setting data for setting the electrode applied with the ejection relevant driving pulse to a high impedance state for a predetermined period. The second high impedance setting register is provided to correspond to the ejection both-side waveform setting register and stores setting data for setting the electrodes applied with the ejection both-side driving pulse to the high impedance state for the predetermined period.

The waveform forming unit forms, from the setting data respectively stored in the ejection relevant waveform setting register and the first high impedance setting register, an ejection relevant driving pulse for setting the electrode of the ink chamber communicating with the ejection relevant nozzle to the high impedance state for the predetermined period and forms, from the setting data respectively stored in the ejection both-side waveform setting register and the second high impedance setting register, an ejection both-side driving pulse for setting the electrodes of the ink chambers communicating with the ejection both-side nozzles to the high impedance state for the predetermined period. The output unit outputs signals of the driving pulses formed by the waveform generating unit to the inkjet head.

Embodiments are explained below with reference to the drawings.

In the embodiments, a pulse generator is applied to a pattern generator included in a driving device of a line-type inkjet head 100 of a share mode type.

First Embodiment

Figure 1:
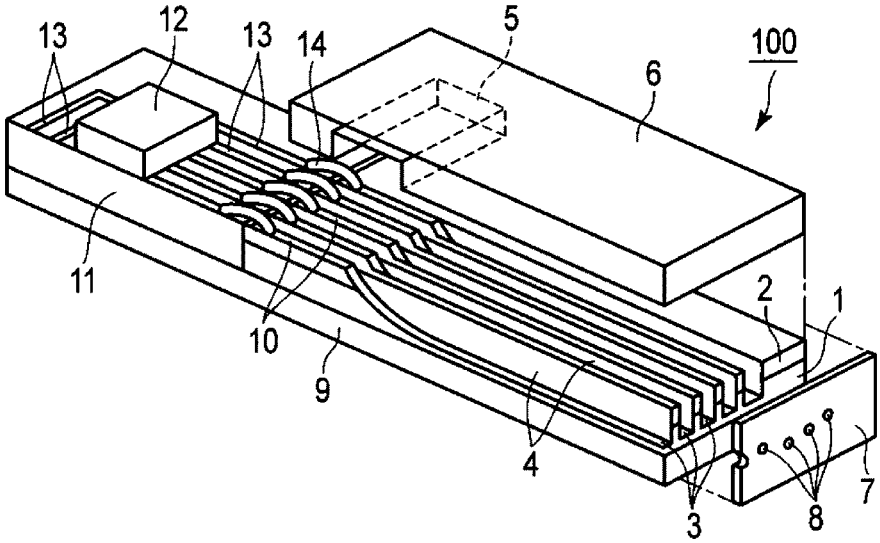
FIG. 1 is a partially exploded perspective view of a line-type inkjet head.
Figure 2:
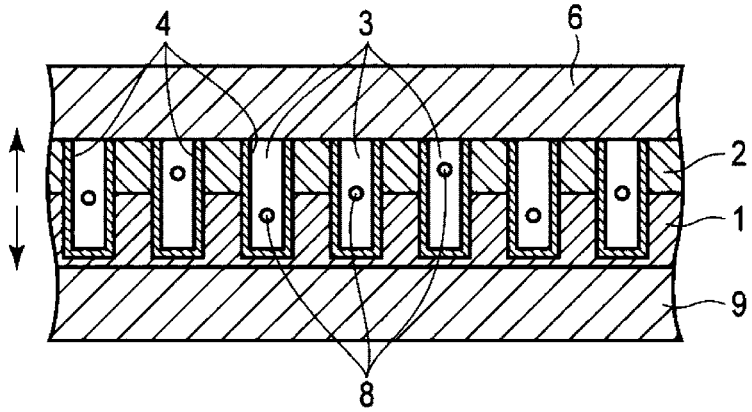
FIG. 2 is a cross sectional view in a front part of the line-type inkjet head.
Figure 3:
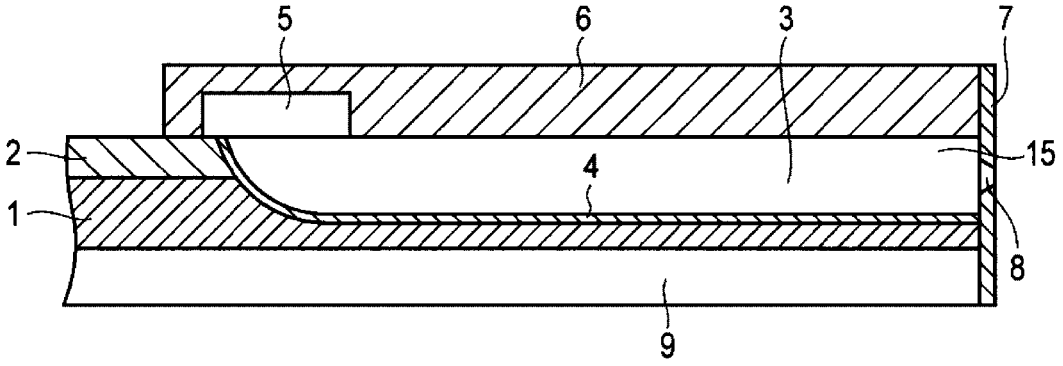
FIG. 3 is a longitudinal sectional view in the front part of the line-type inkjet head.

First, the configuration of the line-type inkjet head 100 (hereinafter abbreviated as head 100) is explained with reference to FIGS. 1 to 3. FIG. 1 is a partially exploded perspective view of the head 100. FIG. 2 is a cross sectional view in a front part of the head 100. FIG. 3 is a longitudinal sectional view in the front part of the head 100.

The head 100 includes a base substrate 9. A first piezoelectric member 1 is joined to the upper surface on the front side of the base substrate 9. A second piezoelectric member 2 is joined on the first piezoelectric member 1. As indicated by arrows in FIG. 2, the first piezoelectric member 1 and the second piezoelectric member 2 are polarized in opposite directions each other along the thickness direction and joined. A large number of long grooves 3 are provided from the front end side toward the rear end side of the joined piezoelectric members 1 and 2. The grooves 3 are provided at a fixed interval and in parallel. The grooves 3 are opened at the front ends and inclined upward at the rear ends.

Electrodes 4 are provided on the sidewalls and the bottom surfaces of the grooves 3. Extraction electrodes 10 are extended from the electrodes 4 at the rear ends of the grooves 3 toward the rear upper surface of the second piezoelectric member 2.

Upper parts of the grooves 3 are closed by a top plate 6. A common ink chamber 5 is provided in the back on the inner side of the top plate 6.

The front ends of the grooves 3 are closed by an orifice plate 7. Ink chambers 15, in which ink is stored, are formed by the grooves 3 surrounded by the top plate 6 and the orifice plate 7. The ink chambers 15 are also referred to as pressure chambers. Nozzles 8 are drilled in positions of the orifice plate 7 opposed to the grooves 3. The nozzles 8 communicate with the grooves 3 opposed to the nozzles 8, i.e., the ink chambers 15.

A printed board 11, on which conductive patterns 13 are formed, is joined to the upper surface on the rear side of the base substrate 9. A drive IC 12 incorporating a head driving unit, which is a driving unit, is mounted on the printed board 11. The drive IC 12 is connected to the conductive patterns 13. The conductive patterns 13 are coupled to the extraction electrodes 10 by lead wires 14 through wire bonding.

The operation principle of the head 100 configured as explained above is explained with reference to FIGS. 4A to 4C.

Figure 4A:
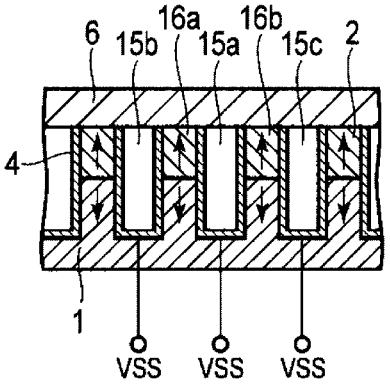
FIGS. 4A to 4C are diagrams for explaining an operation principle of the line-type inkjet head.

FIG. 4A shows a state in which all the potentials of the electrodes 4 respectively disposed on the wall surfaces of an ink chamber 15*a* in the center and ink chambers 15*b* and 15*c* on both sides adjacent to the ink chamber 15*a* are a ground voltage VSS. In this state, both of a partition wall 16*a* sandwiched by the ink chamber 15*a* and the ink chamber 15*b* and a partition wall 16*b* sandwiched by the ink chamber 15*a* and the ink chamber 15*c* are not subjected to straining at all.

Figure 4B:
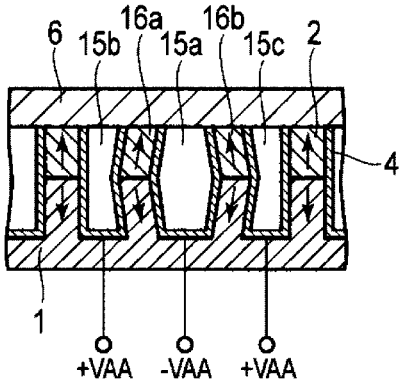

FIG. 4B shows a state in which a negative voltage −VAA is applied to the electrode 4 of the ink chamber 15*a* in the center and a positive voltage +VAA is applied to the electrodes 4 of the ink chambers 15*b* and 15*c* on both sides of the ink chamber 15*a*. In this state, electric fields act on the partition walls 16*a* and 16*b* in directions orthogonal to the polarization directions of the piezoelectric members 1 and 2. According to this action, the partition walls 16*a* and 16*b* are respectively deformed to the outer sides to increase the capacity of the ink chamber 15*a*.

Figure 4C:
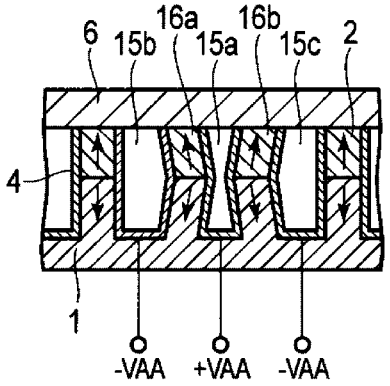

FIG. 4C shows a state in which the positive voltage +VAA is applied to the electrode 4 of the ink chamber 15*a* in the center and the negative voltage −VAA is applied to the electrodes 4 of the ink chambers 15*b* and 15*c* on both sides of the ink chamber 15*a*. In this state, electric fields act on the partition walls 16*a* and 16*b* in directions opposite to the directions in the case of in FIG. 4B. According to this action, the partition walls 16*a* and 16*b* are respectively deformed to the inner sides to reduce the capacity of the ink chamber 15*a*.

When the capacity of the ink chamber 15*a* is increased or reduced, pressure vibration occurs in the ink chamber 15*a*. According to the pressure vibration, the pressure in the ink chamber 15*a* increases and ink droplets are ejected from the nozzle 8 communicating with the ink chamber 15*a*.

In this way, the partition walls 16*a* and 16*b* portioning the ink chambers 15*a*, 15*b*, and 15*c* function as actuators for applying pressure vibration to the inside of the ink chamber 15*a* including the partition walls 16*a* and 16*b* as wall surfaces. Therefore, the ink chambers 15 respectively share the actuators with the adjacent ink chambers 15. Consequently, the driving device of the head 100 cannot individually drive the ink chambers 15. The driving device divides the ink chambers 15 into (n+1) groups at an interval of n (n is an integer equal to or larger than 2) and drives the ink chambers 15. In an example explained in this embodiment, the driving device performs so-called three-division driving for dividing the ink chambers 15 into three sets at an interval of two and dividedly driving the ink chambers 15. The three-division driving is only an example. The divided driving may be four-division driving or five-division driving.

A relation between changes in states of the ink chambers 15 in the case of the three-division driving of the head 100 and driving pulse voltages applied to the electrodes 4 of the ink chambers 15 according to the changes in the states is explained with reference to FIGS. 5 and 6. In the figures, nozzle Nos. i (i=0 to 8) are peculiar numbers allocated to the nozzles 8 respectively communicating with the ink chambers 15 corresponding thereto. In this embodiment, nozzle Nos. i=0, 1, 2, 3, . . . are given to the nozzles 8 in order from the left viewed from the outer side of the orifice plate 7. In the following explanation, for convenience of the explanation, the nozzle 8 numbered with the nozzle No. i is represented by a sign 8-i and the ink chamber 15 communicating with the nozzle 8-i is represented by a sign 15-i. A partition wall partitioning an ink chamber 15 (i−1) and the ink chamber 15-i is represented by a sign 16-(i−1)i.

Figure 5:
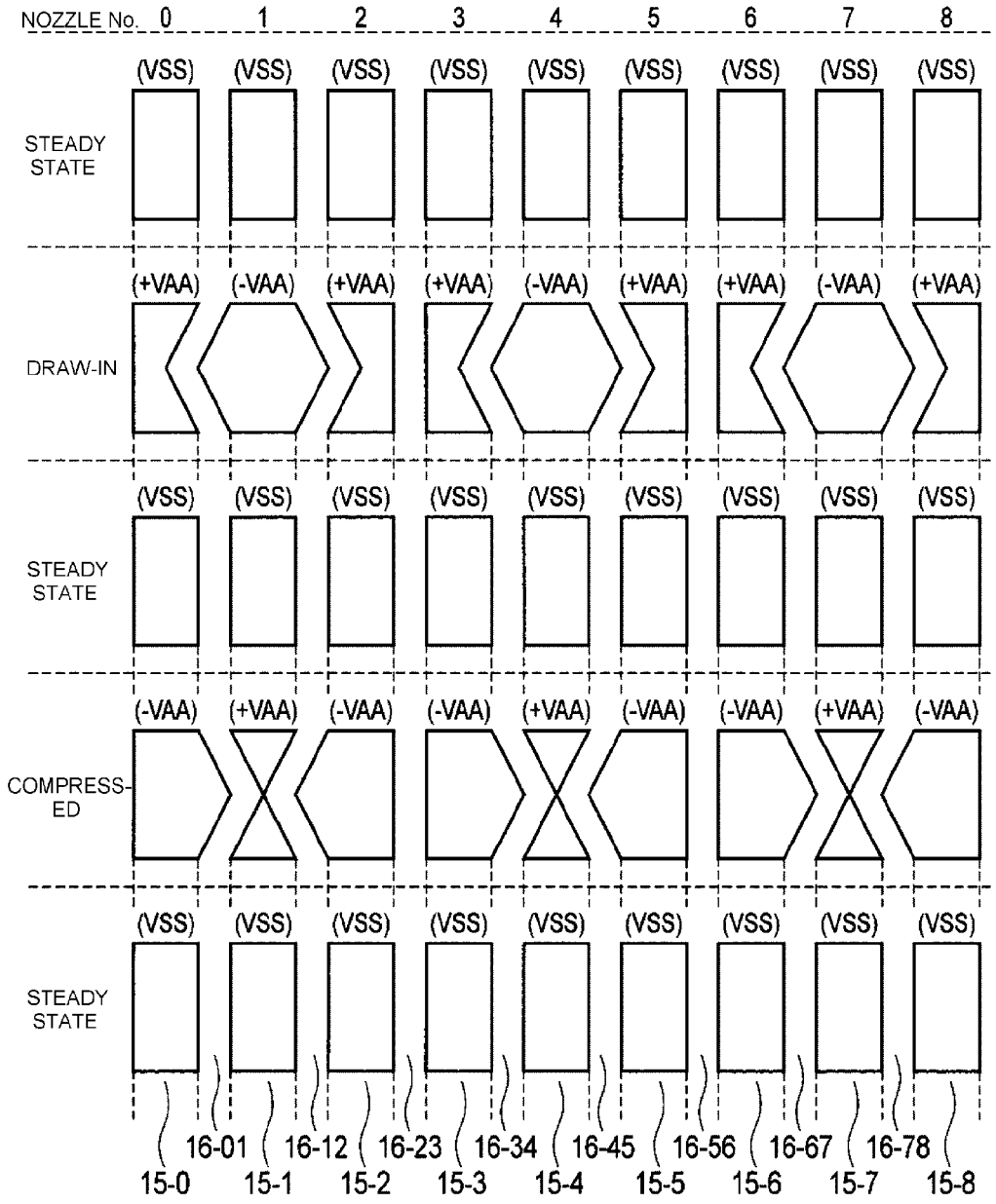
FIG. 5 is a schematic diagram of an example of a relation between states of ink chambers and driving pulse voltages in the case of three-division driving of the line-type inkjet head.
Figure 6:
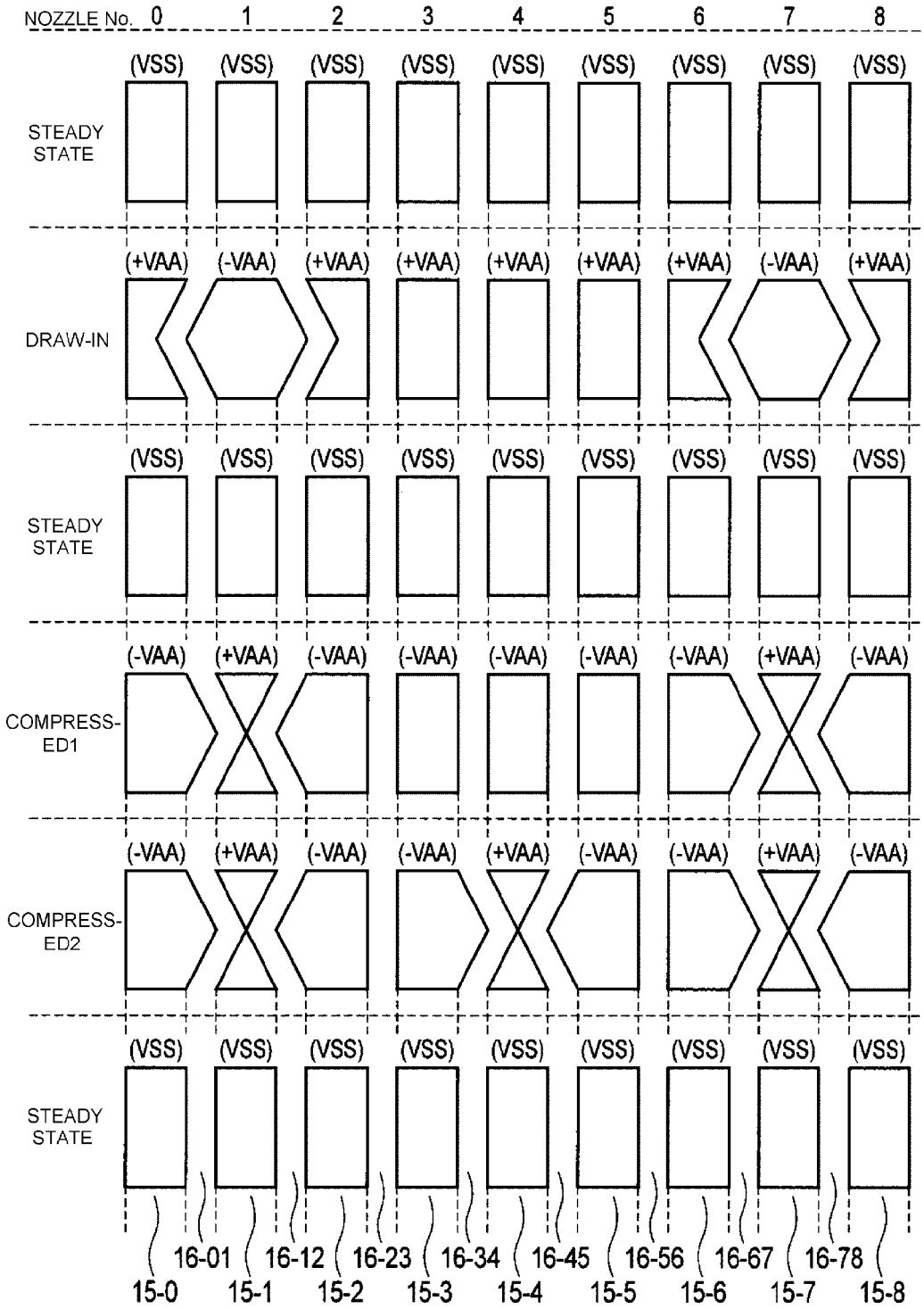
FIG. 6 is a schematic diagram of another example of the relation between the states of the ink chambers and the driving pulse voltages in the case of the three-division driving of the line-type inkjet head.

In FIGS. 5 and 6, ink chambers 15-0, 15-3, and 15-6 respectively communicating with nozzles 8-0, 8-3, and 8-6 with the nozzle Nos. i=0, 3, and 6 belong to the same group. Ink chambers 15-1, 15-4, and 15-7 respectively communicating with nozzles 8-1, 8-4, and 8-7 with the nozzle Nos. i=1, 4, and 7 belong to the same group. Ink chambers 15-2, 15-5, and 15-8 respectively communicating with nozzles 8-2, 8-5, and 8-8 with the nozzle Nos. i=2, 5, and 8 belong to the same group.

In FIG. 5, the ink is ejected from the nozzles 8-1, 8-4, and 8-7 with the nozzle Nos. i=1, 4, and 7. In this case, the ink chambers 15-0 to 15-8 change in the order of a steady state, a draw-in state, the steady state, a compressed state, and the steady state.

In the steady state, the driving device sets the electrodes 4 of the ink chambers 15-0 to 15-8 to the ground voltage VSS. In the draw-in state, the driving device applies the negative voltage −VAA to the electrodes 4 of the ink chambers 15-1, 15-4, and 15-7, which are ink ejection targets, and applies the positive voltage +VAA to the electrodes 4 of the ink chambers 15-0, 15-2, 15-3, 15-5, 15-6, and 15-8 arranged on both sides of the ink chambers 15-1, 15-4, and 15-7. That is, the driving device sets the ink chambers to a pattern shown in FIG. 4B. Conversely, in the compressed state, the driving device applies the positive voltage +VAA to the electrodes 4 of the ink chambers 15-1, 15-4, and 15-7 and applies the negative voltage −VAA to the electrodes 4 of the ink chambers 15-0, 1-2, 15-3, 15-5, 15-6, and 15-8. That is, the driving device sets the ink chambers to a pattern shown in FIG. 4C. According to the state change of the ink chambers 15-0 to 15-8 shown in FIG. 5, ink droplets are ejected from the nozzles 8-1, 8-4, and 8-7.

In FIG. 6, the ink is ejected from the nozzles 8-1 and 8-7 with the nozzle Nos. i=1 and 7. The ink chamber 15-4 communicating with the nozzle 8-4 with the nozzle No. i=4 belonging to the same group as the nozzle Nos. i=1 and 7 performs an auxiliary operation for absorbing voltage vibration of the ink chamber 15-1 and the ink chamber 15-7. In this case, the ink chambers 15-0 to 15-8 change in the order of the steady state, the draw-in state, the steady state, a first compressed state, a second compressed state, and the steady state.

In the steady state, the driving device sets the electrodes 4 of the ink chambers 15-0 to 15-8 to the ground voltage VSS. In the draw-in state, the driving device applies the negative voltage −VAA to the electrodes 4 of the ink chamber 15-1 and the ink chamber 15-7, which are ink ejection targets, and applies the positive voltage +VAA to the electrodes 4 of the ink chambers 15-0 and 15-2 and the ink chambers 15-6 and 15-8 arranged on both sides of the ink chamber 15-1 and the ink chamber 15-7. According to such control of driving pulse voltages, the capacities of the ink chamber 15-1 and the ink chamber 15-7 are increased.

In the ink chamber 15-2 adjacent to the ink chamber 15-1, since a partition wall 16-12 on the ink chamber 15-1 side is deformed, it is likely that ink droplets are ejected by mistake. Therefore, the driving device controls a driving pulse voltage to prevent a partition wall 16-23 on the ink chamber 15-3 side from being deformed. That is, the driving device applies a voltage of the same potential as the electrode 4 of the ink chamber 15-2, that is, the positive voltage +VAA to the electrode 4 of the ink chamber 15-3. Since the electrode 4 of the ink chamber 15-2 changes to the same potential as the electrode 4 of the ink chamber 15-3, the partition wall 16-23 sandwiched by the ink chamber 15-2 and the ink chamber 15-3 is not deformed.

From the same reason, the driving device applies the positive voltage +VAA to the electrode 4 of the ink chamber 15-5 adjacent to the ink chamber 15-6 as well. As a result, the electrodes 4 of the ink chambers 15-3 and 15-5 arranged on both sides of the ink chamber 15-4, which performs the auxiliary operation, changes to the positive voltage +VAA. Therefore, the driving device applies the positive voltage +VAA to the electrode 4 of the ink chamber 15-4 as well to prevent partition walls 16-34 and 16-45 on both sides of the ink chamber 15-4 from being deformed.

In the first compressed state, the driving device applies the positive voltage +VAA to the electrodes 4 of the ink chamber 15-1 and the ink chamber 15-7 and applies the negative voltage −VAA to the electrodes 4 of the ink chambers 15-0 and 15-2 and the ink chambers 15-6 and 15-8 arranged on both sides of the ink chamber 15-1 and the ink chamber 15-7. From the viewpoint of preventing the wrong ejection, the driving device applies the negative voltage −VAA to the electrodes 4 of the ink chamber 15-4, which performs the auxiliary operation, and the ink chambers 15-3 and 15-5 on both sides of the ink chamber 15-4 as well.

In the second compressed state, the driving device applies the positive voltage +VAA to the electrode 4 of the ink chamber 15-4, which performs the auxiliary operation. When the positive voltage +VAA is applied to the electrode 4 of the ink chamber 15-4, a potential difference occurs between the electrodes 4 respectively disposed on the partition walls 16-34 and 16-45 on both sides of the ink chamber 15-4. The partition walls 16-34 and 16-45 are deformed in a direction for compressing the ink chamber 15-4. According to the deformation, pressure vibration that occurs in the ink chamber 15-1 and the ink chamber 15-7 is absorbed.

As shown in FIG. 5, in the ink chambers 15-0, 15-2, 15-3, 15-5, 15-6, and 15-8 respectively located on both sides of the ink chambers 15-1, 15-4, and 15-7, which are ink ejection targets, patterns of driving pulse voltages applied to the electrodes 4 are the same. As shown in FIG. 6, in the ink chambers 15-3 and 15-5 located on both sides of the ink chamber 15-4, which performs the auxiliary operation, patterns of driving pulse voltages applied to the electrodes 4 are also the same. Therefore, in a control sequence of a driving pulse voltage for the head 100, it often occurs that the electrodes 4 of at least three ink chambers 15 provided side by side while being partitioned by partition walls adjacent thereto have the same potential.

As explained above, from the electrical point of view, the head 100 of the share mode type is equivalent to a circuit in which capacitors are connected in series and has stray capacitance. Therefore, when the electrodes 4 of the at least three ink chambers 15 provided side by side have the same potential, a noise current occurs in the head 100 and power supply is uselessly consumed. In order to prevent such a deficiency, in this embodiment, a physical characteristic of capacitors explained with reference to FIG. 7 is used.

Figure 7:
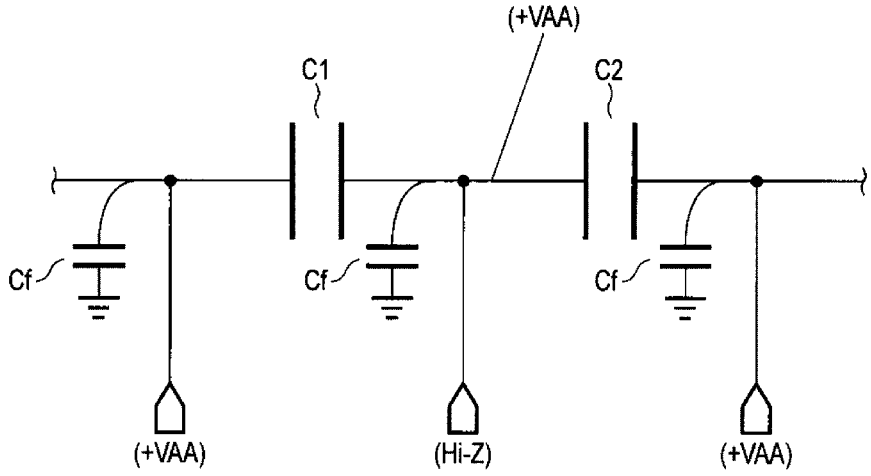
FIG. 7 is a circuit diagram for explaining a physical characteristic of capacitors.

FIG. 7 shows a series circuit of capacitors C1 and C2. In the figure, a sign Cf represents stray capacitance. In the series circuit, the capacitor C1 and the capacitor C2 are in a high impedance (Hi-Z) state. In this state, when voltages (in FIG. 7, the positive voltages +VAA) of the same potential are simultaneously applied to both ends of the series circuit, an induced voltage of the same potential (in FIG. 7, the positive voltage +VAA) as the applied voltages is generated between the capacitors C1 and C2. That is, a series circuit of capacitors has a characteristic that, when voltages of the same potential are simultaneously applied to both ends of the circuit, an induced voltage of the same potential as the applied voltages is generated between the capacitors.

Therefore, the driving device sets the electrode 4 of the ink chamber 15-i located on the inner side among at least three ink chambers 15-(i−1), 15-i, and 15-(i+1) provided side by side across partition walls to the high impedance state. The driving device simultaneously applies voltages of the same potential to the electrodes 4 of the ink chambers 15-(i−1) and 15-(i+1) located on both sides of the ink chamber 15-i. Then, a voltage of the same potential is induced to the electrode 4 of the ink chamber 15-i located on the inner side. As a result, the potentials of the electrodes 4 of the at least three ink chambers 15-(i−1), 15-i, and 15-(i+1) provided side by side are equalized.

The potential of the electrode 4 disposed in the ink chamber 15-i is generated by the induced voltage. A driving pulse voltage is not applied to the electrode 4. Therefore, a noise current and useless power consumption due to stray capacitance do not occur.

Figure 8:
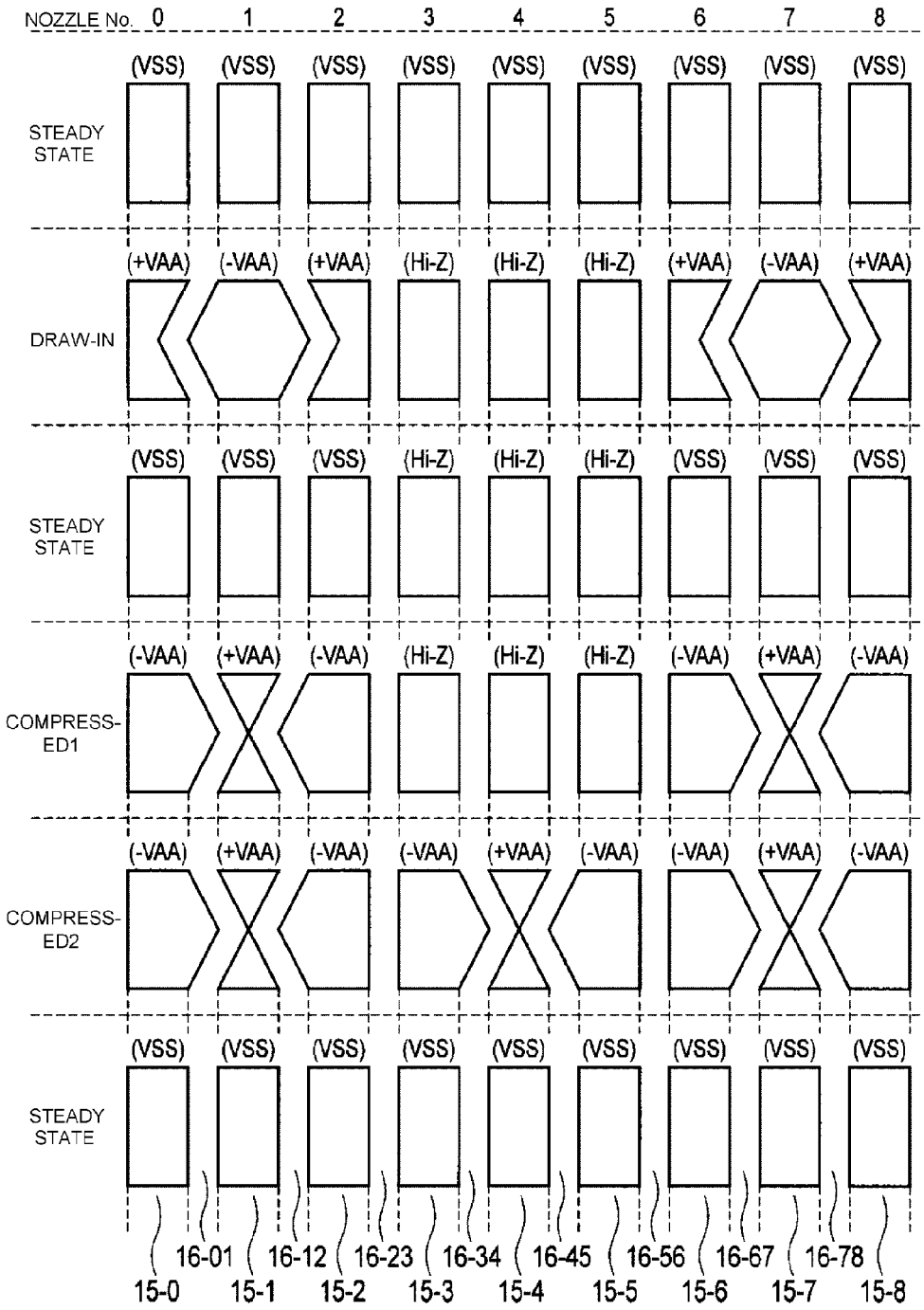
FIG. 8 is a schematic diagram of an example of a relation between states of the ink chambers and driving pulse voltages in the case of the three-division driving of the line-type inkjet head.

FIG. 8 is a specific example in which the physical characteristic is applied to the pattern of the driving pulse voltage shown in FIG. 6. As shown in FIG. 6, in five ink chambers 15-2 to 15-6 provided side by side with the ink chamber 15-4, which performs the auxiliary operation, provided in the center, the pattern of the driving pulse voltage applied to the electrodes 4 is common from the draw-in state to the first compression state. Therefore, as shown in FIG. 8, concerning three ink chambers 15-3 to 15-5 excluding the ink chambers 15-2 and 15-6 located on both sides among the five ink chambers 15-2 to 15-6, the electrodes 4 are set in the high impedance state from the draw-in state to the first compressed state.

When timing of the draw-in state comes, the driving device applies the positive voltage +VAA to the electrodes 4 of the ink chambers 15-2 and 15-6 located on both the sides. Then, as indicated by a pattern P1 shown in an equivalent circuit diagram of FIG. 9, the positive voltage +VAA is induced to the electrodes 4 of the ink chambers 15-3 to 15-5 located on the inner side. As a result, voltage patterns of the electrodes 4 respectively disposed in the ink chambers 15-2 to 15-6 coincide with a voltage pattern of the draw-in state.

Thereafter, when timing of the steady state comes, the driving device sets the electrodes 4 of the ink chambers 15-2 and 15-6 located on both the sides to the ground voltage VSS. Then, as indicated by a pattern P2, the electrodes 4 of the ink chambers 15-3 to 15-5 located on the inner side also change to the ground voltage VSS. As a result, voltage patterns of the electrodes 4 coincide with a voltage pattern of the steady state.

Thereafter, when timing of the first compressed state comes, the driving device applies the negative voltage −VAA to the electrodes 4 of the ink chambers 15-2 and 15-6 located on both the sides. Then, as indicated by a pattern P3, the negative voltage −VAA is induced to the electrodes 4 of the ink chambers 15-3 to 15-5 located on the inside. As a result, voltage patterns of the electrodes 4 coincide with a voltage pattern of the first compressed state.

In this way, in a section from the draw-in state to the first compressed state, even when the electrodes 4 of the ink chamber 15-4, which performs the auxiliary operation, and the ink chambers 15-3 and 15-5 on both sides of the ink chamber 15-4 are controlled to the high impedance state, voltages are induced to the electrodes 4 of the ink chambers 15-3, 15-4, and 15-5 in a pattern same as the pattern shown in FIG. 6. Therefore, the voltage does not affect an ink ejecting operation.

Figure 9:
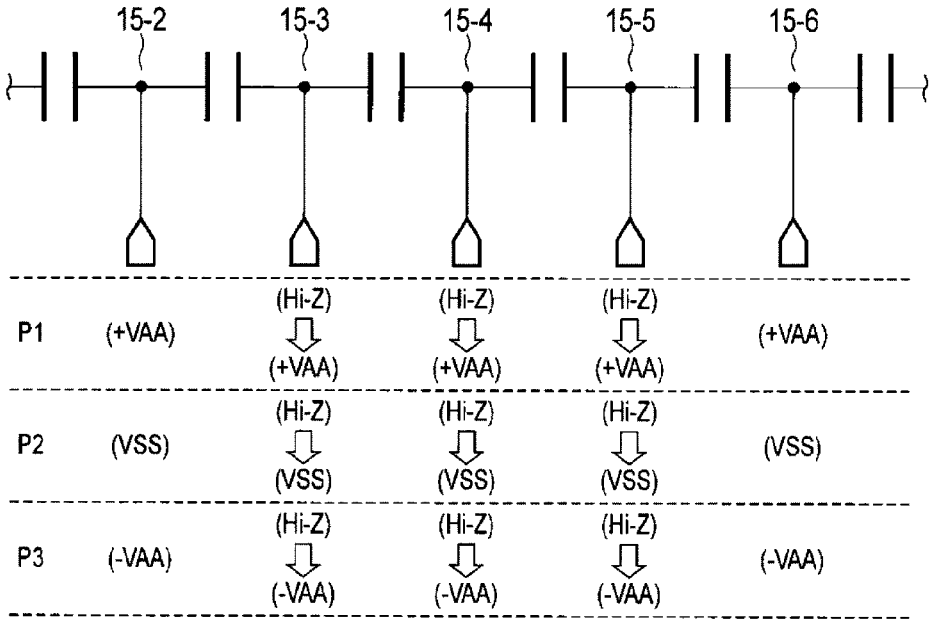
FIG. 9 is a diagram showing an example of an equivalent circuit of the line-type inkjet head and applied voltage patterns.

In FIG. 9, in the steady state after the draw-in state, the electrodes 4 of the ink chambers 15-3 to 15-5 located on the inner side are set to the high impedance state. However, in the steady state, the voltage pattern may be controlled to set the electrodes 4 to the ground voltage VSS rather than the high impedance state.

Figure 10:
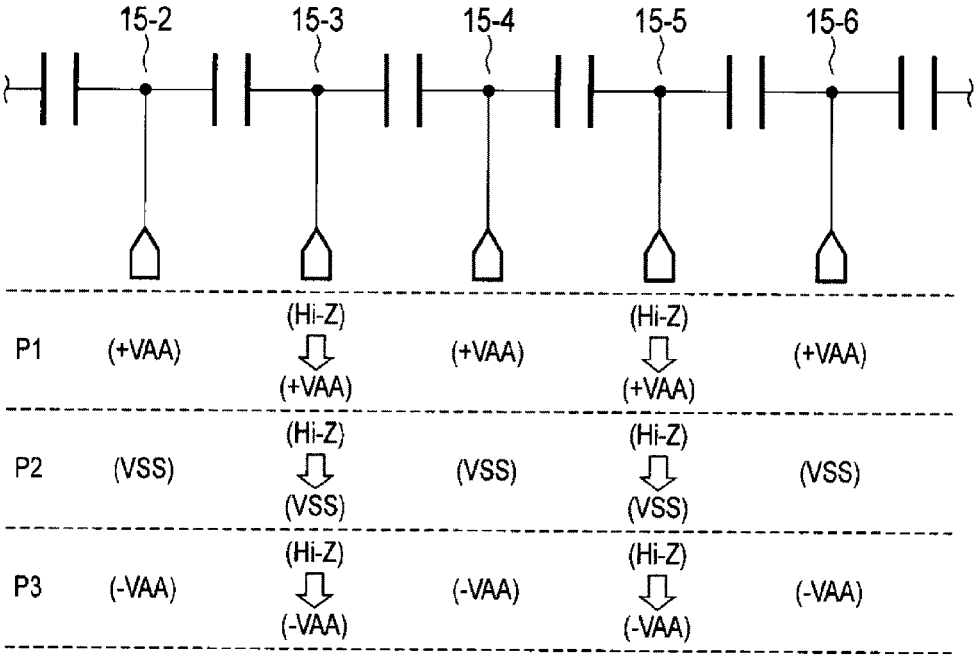
FIG. 10 is a diagram of another example of the equivalent circuit of the line-type inkjet head and the applied voltage patterns.

As shown in FIG. 10, it is also possible that, among the ink chambers 15-3 to 15-5 located on the inner side, for the ink chamber 15-4, which performs the auxiliary operation, the electrode 4 is not set to the high impedance state and only the electrodes 4 of the ink chambers 15-3 and 15-5 adjacent on both sides of the ink chamber 15-4 are set to the high impedance state. Consequently, voltages applied to the ink chambers 15-2 and 15-4 located on both sides of the ink chamber 15-3 are induced to the electrode 4 of the ink chamber 15-3. Voltages applied to the ink chambers 15-4 and 15-6 on both sides of the ink chamber 15-5 are induced to the electrode 4 of the ink chamber 15-5. Therefore, the potentials of the electrodes 4 of the five ink chambers 15-2 to 15-6 provided side by side are surely equalized.

Figure 11:
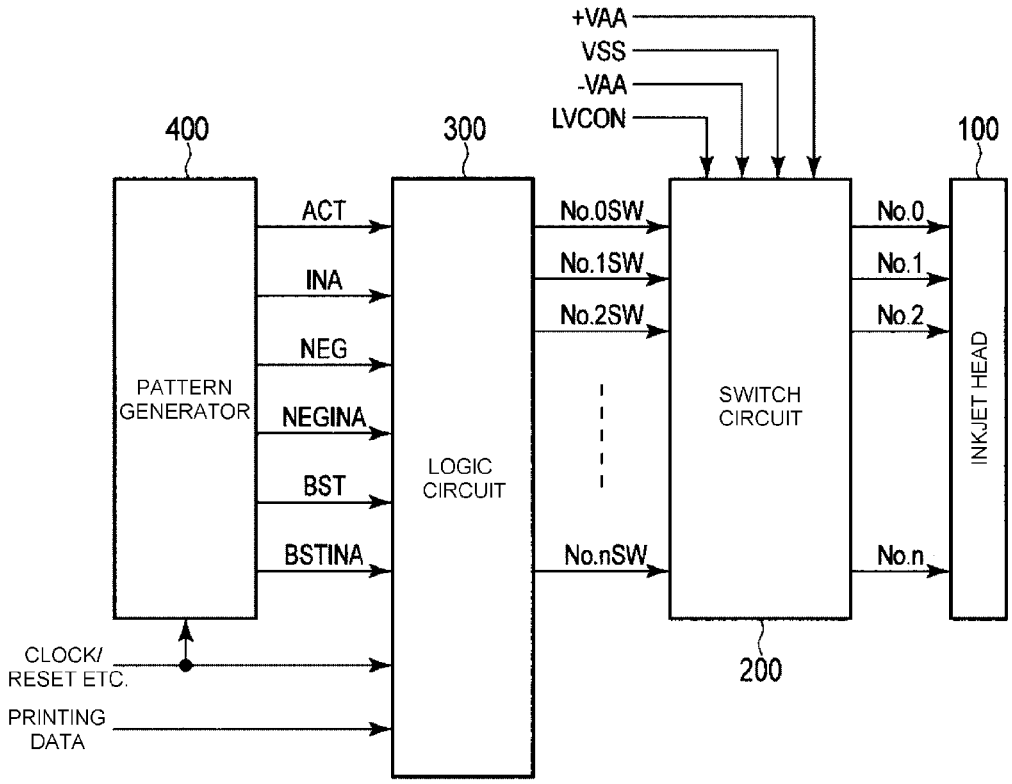
FIG. 11 is a block diagram of the schematic configuration of a line-type inkjet head driving device.

FIG. 11 is a block diagram of the driving device of the head 100. The driving device includes a switch circuit 200, a logic circuit 300, and a pattern generator 400.

The switch circuit 200 includes (n+1) control switches SWx (x=0 to n) respectively corresponding to all nozzles 8-0 to 8-n with nozzle Nos. 0 to n (n≥1) of the head 100. The positive voltage +VAA, the negative voltage −VAA, the ground voltage VSS, and a common voltage LVCON are supplied to the switch circuit 200 from a not-shown power supply circuit. Control signals No. xSW (x=0 to n) respectively corresponding to the control switches SWx are input to the switch circuit 200 from the logic circuit 300. The common voltage LVCON is selected out of the positive voltage +VAA, the negative voltage −VAA, and the ground voltage VSS and applied to all the control switches SWx in common.

Figures 12, 13:
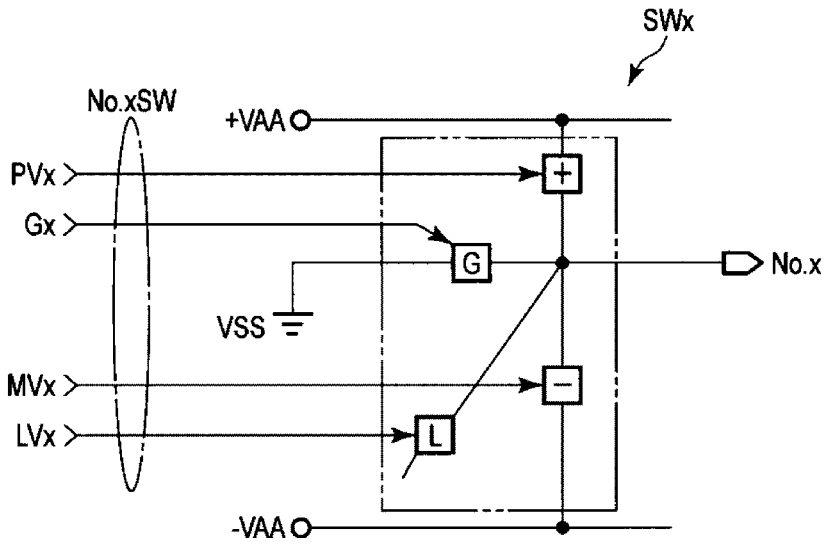
FIG. 12 is a circuit diagram of a control switch.
FIG. 13 is a diagram of a truth table used for explanation of the operation of a logic circuit.

FIG. 12 is a circuit diagram of the control switch SWx. In the control switch SWx, output terminals of a positive voltage contact [+], a negative voltage contact [−], a ground contact [G], and a common voltage contact [L] are connected to an output terminal No. x to the head 100. An input end of the positive voltage contact [+] is connected to a terminal of the positive voltage +VAA. An input terminal of the negative voltage contact [−] is connected to a terminal of the negative voltage −VAA. An input terminal of the ground contact [G] is connected to a terminal of the ground voltage VSS. An input terminal of the common voltage contact [L] is connected to a terminal (not shown) of the common voltage LVCON. The positive voltage contact [+] connects the input end and an output end while a positive voltage pulse signal PVx is on. The negative voltage contact [−] connects the input end and an output end while a negative voltage pulse signal MVx is on. The ground contact [G] connects the input end and an output end while a ground signal Gx is on. The common voltage contact [L] connects the input end and an output end while a common voltage signal LVx is on. The positive voltage pulse signal PVx, the negative voltage pulse signal MVx, the ground signal Gx, and the common voltage signal LVx are included in the control signal No. xSW input from the logic circuit 300.

The logic circuit 300 sets, for each one printing line, states of the control switches SWx according to printing data supplied from an external apparatus. The logic circuit 300 generates the control signals No. xSW respectively corresponding to the control switches SWx to control the control switches SWx to the set states. The logic circuit 300 outputs the control signals No. xSW to the switch circuit 200 while adjusting output timing such that the ink chambers 15 are subjected to three-division driving according to clock/reset signals.

An ACT signal, an INA signal, a NEG signal, a NEGINA signal, a BST signal, and a BSTINA signal are input to the logic circuit 300 from the pattern generator 400. The ACT signal is a voltage signal of a driving pulse applied to the electrode 4 of the ink chamber 15 communicating with a nozzle that ejects ink droplets according to division driving (hereinafter referred to as ejection relevant nozzle). The INA signal is a voltage signal of a driving pulse applied to the electrodes 4 of the ink chambers 15 communicating with nozzles adjacent on both sides of the ejection relevant nozzle (hereinafter referred to as ejection both-side nozzles). The NEG signal is a voltage signal of a driving pulse applied to the electrode 4 of the ink chamber 15 communicating with a nozzle that does not eject ink droplets in division driving (hereinafter referred to as non-ejection relevant nozzle). The NEGINA signal is a voltage signal of a driving pulse applied to the electrodes 4 of the ink chambers 15 communicating with nozzles adjacent on both sides of the non-ejection relevant nozzle (hereinafter referred to as non-ejection both-side nozzles). The BST signal is a voltage signal of a driving pulse applied to the electrode 4 of the ink chamber 15 communicating with a nozzle that performs an auxiliary operation in the division driving (hereinafter referred to as auxiliary relevant nozzle). The BSTINA signal is a voltage signal of a driving pulse applied to the electrodes 4 of the ink chambers 15 communicating with nozzles adjacent on both sides of the auxiliary relevant nozzle (hereinafter referred to as auxiliary both-side nozzles).

The control signal No. xSW for the control switch SWx corresponding to the ejection relevant nozzle is generated by the ACT signal. The control signal No. xSW for the control switch SWx corresponding to the ejection both-side nozzles is generated by the INA signal. The control signal No. xSW for the control switch SWx corresponding to the non-ejection relevant nozzle is generated by the NEG signal. The control signal No. xSW for the control switch SWx corresponding to the non-ejection both-side nozzles is generated by the NEGINA signal. The control signal No. xSW for the control switch SWx corresponding to the auxiliary relevant nozzle is generated by the BST signal. The control signal No. xSW for the control switch SWx corresponding to the auxiliary both-side nozzles is generated by the BSTINA signal.

As described on the left side of a truth table 500 shown in FIG. 13, codes representing a driving pulse voltage in time series include a 2-bit potential code and a 1-bit high impedance designation code (hereinafter referred to as Hi-Z designation code).

The logic circuit 300 generates the control signals No. xSW according to the truth table 500. That is, at timing when the potential code is [00] and the Hi-Z designation code is [0], the logic circuit 300 generates the control signal No. xSW in which the ground signal Gx is in an ON state. At timing when the potential code is [01] and the Hi-Z designation code is [0], the logic circuit 300 generates the control signal No. xSW in which the positive voltage pulse signal PVx is in the ON state. At timing when the potential code is [10] and the Hi-Z designation code is [0], the logic circuit 300 generates the control signal No. xSW in which the negative voltage pulse signal MVx is in the ON state. At timing when the potential code is [11] and the Hi-Z designation code is [0], the logic circuit 300 generates the control signal No. xSW in which the common voltage signal LVx is in the ON state.

At timing when the Hi-Z designation code is [1] irrespective of the potential code, the logic circuit 300 generates the control signal No. xSW in which all of the positive voltage pulse signal PVx, the negative voltage pulse signal MVx, the ground signal Gx, and the common voltage signal LVx are in an OFF state. That is, the Hi-Z designation code has higher priority than the potential code.

The electrode 4 of the ink chamber 15 communicating with the ejection relevant nozzle is controlled to the high impedance state according to such a control signal No. xSW. Therefore, for convenience of explanation, the control signal No. xSW in which all of the positive voltage pulse signal PVx, the negative voltage pulse signal MVx, the ground signal Gx, and the common voltage signal LVx are in the OFF state is referred to as a high impedance control signal.

Figure 14:
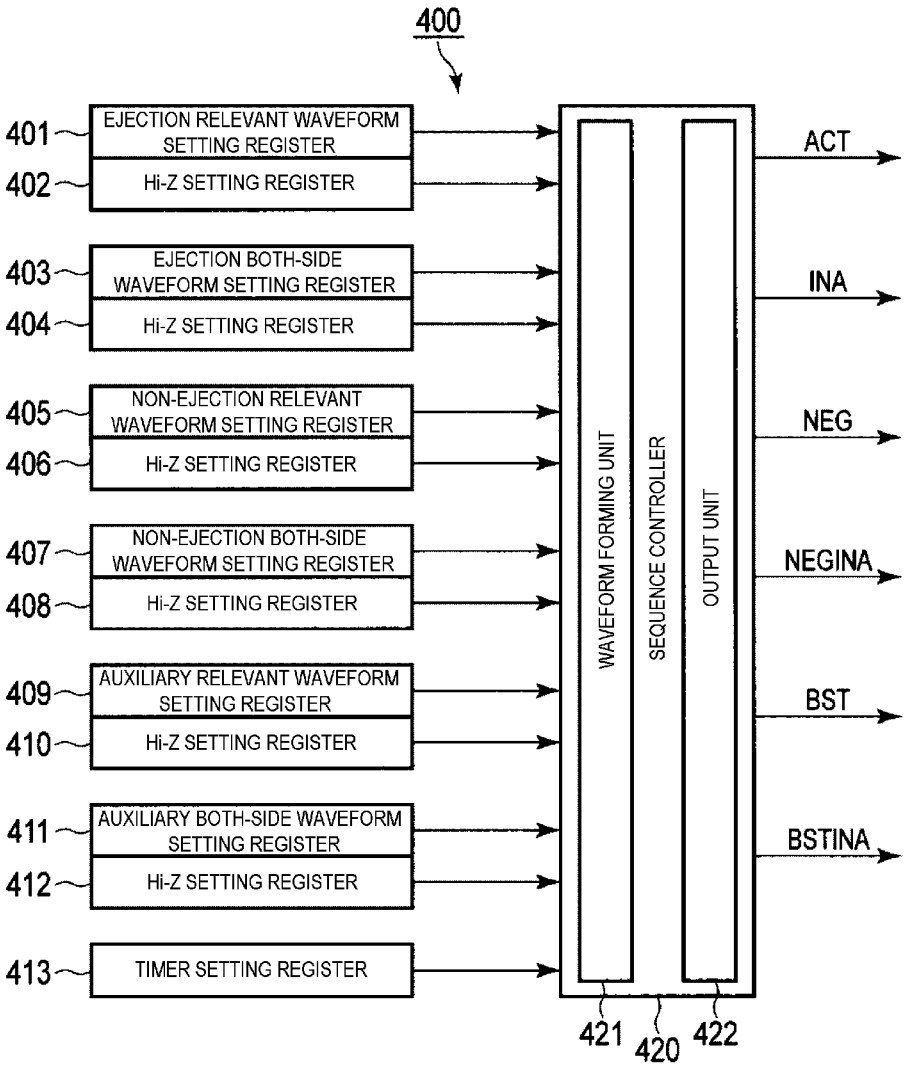
FIG. 14 is a block diagram of a pattern generator according to an embodiment.

FIG. 14 is a block diagram of the pattern generator 400. The pattern generator 400 is configured from a register group and a sequence controller 420 and functions as a pulse generator. The register group includes an ejection relevant waveform setting register 401, an ejection both-side waveform setting register 403, a non-ejection relevant waveform setting register 405, a non-ejection both-side waveform setting register 407, an auxiliary relevant waveform setting register 409, an auxiliary both-side waveform setting register 411, first to sixth high impedance setting registers (hereinafter abbreviated as Hi-Z setting registers) 402, 404, 406, 408, 410, and 412 provided to respectively correspond to the waveform setting registers 401, 403, 405, 407, 409, and 411, and a timer setting register 413.

In the ejection relevant waveform setting register 401, a potential code representing, in time series, a voltage waveform of a driving pulse applied to the electrode 4 of the ink chamber 15 communicating with the ejection relevant nozzle is set. In the ejection both-side waveform setting register 403, a potential code representing, in time series, a voltage waveform of a driving pulse applied to the electrodes 4 of the ink chambers 15 communicating with the ejection both-side nozzles is set. In the non-ejection relevant waveform setting register 405, a potential code representing, in time series, a voltage waveform of a driving pulse applied to the electrode 4 of the ink chamber 15 communicating with the non-ejection relevant nozzle is set. In the non-ejection both-side waveform setting register 407, a potential code representing, in time series, a voltage waveform of a driving pulse applied to the electrodes 4 of the ink chambers 15 communicating with the non-ejection both-side nozzles is set. In the auxiliary relevant waveform setting register 409, a potential code representing, in time series, a voltage waveform of a driving pulse applied to the electrode 4 of the ink chamber 15 communicating with the auxiliary relevant nozzle is set. In the auxiliary both-side waveform setting register 411, a potential code representing, in time series, a voltage waveform of a driving pulse applied to the electrodes 4 of the ink chambers 15 communicating with the auxiliary both-side nozzles is set.

In the first to sixth Hi-Z setting registers 402, 404, 406, 408, 410, and 412, Hi-Z designation codes representing, in time series, whether the electrodes 4 applied with the driving pulse voltages of the potential codes set in the waveform setting registers 401, 403, 405, 407, 409, and 411 corresponding to the Hi-Z setting registers 402, 404, 406, 408, 410, and 412 are controlled to the high impedance state are set.

In the timer setting register 413, timer values indicating timings for reading out codes from the wavelength setting registers 401 to 412 are set.

The sequence controller 420 has a function of a waveform forming unit 421 and a function of an output unit 422. That is, the sequence controller 420 sequentially reads out, according to the timer values set in the timer setting register 413, a potential code and a Hi-Z designation code from the ejection relevant waveform setting register 401 and the Hi-Z setting register 402. The sequence controller 420 forms an ACT signal (an ejection relevant driving pulse) from the read-out two kinds of codes and outputs the ACT signal to the logic circuit 300.

Similarly, the sequence controller 420 forms an INA signal (an ejection both-side driving pulse) from two kinds of codes read out from the ejection both-side waveform setting register 403 and the Hi-Z setting register 404 and outputs the INA signal to the logic circuit 300. The sequence controller 420 forms a NEG signal (a non-ejection relevant driving pulse) from two kinds of codes readout from the non-ejection relevant waveform setting register 405 and the Hi-Z setting register 406 and outputs the NEG signal to the logic circuit 300. The sequence controller 420 forms a NEGINA signal (a non-ejection both-side driving pulse) from two kinds of codes read out from the non-ejection both-side waveform setting register 407 and the Hi-Z setting register 408 and outputs the NEGINA signal to the logic circuit 300. The sequence controller 420 forms a BST signal (an auxiliary relevant driving pulse) from two kinds of codes read out from the auxiliary relevant waveform setting register 409 and the Hi-Z setting register 410 and outputs the BST signal to the logic circuit 300. The sequence controller 420 forms a BSTINA signal (an auxiliary both-side driving pulse) from two kinds of codes read out from the auxiliary both-side waveform setting register 411 and the Hi-Z setting register 412 and outputs the BSTINA signal to the logic circuit 300.

Figure 15:
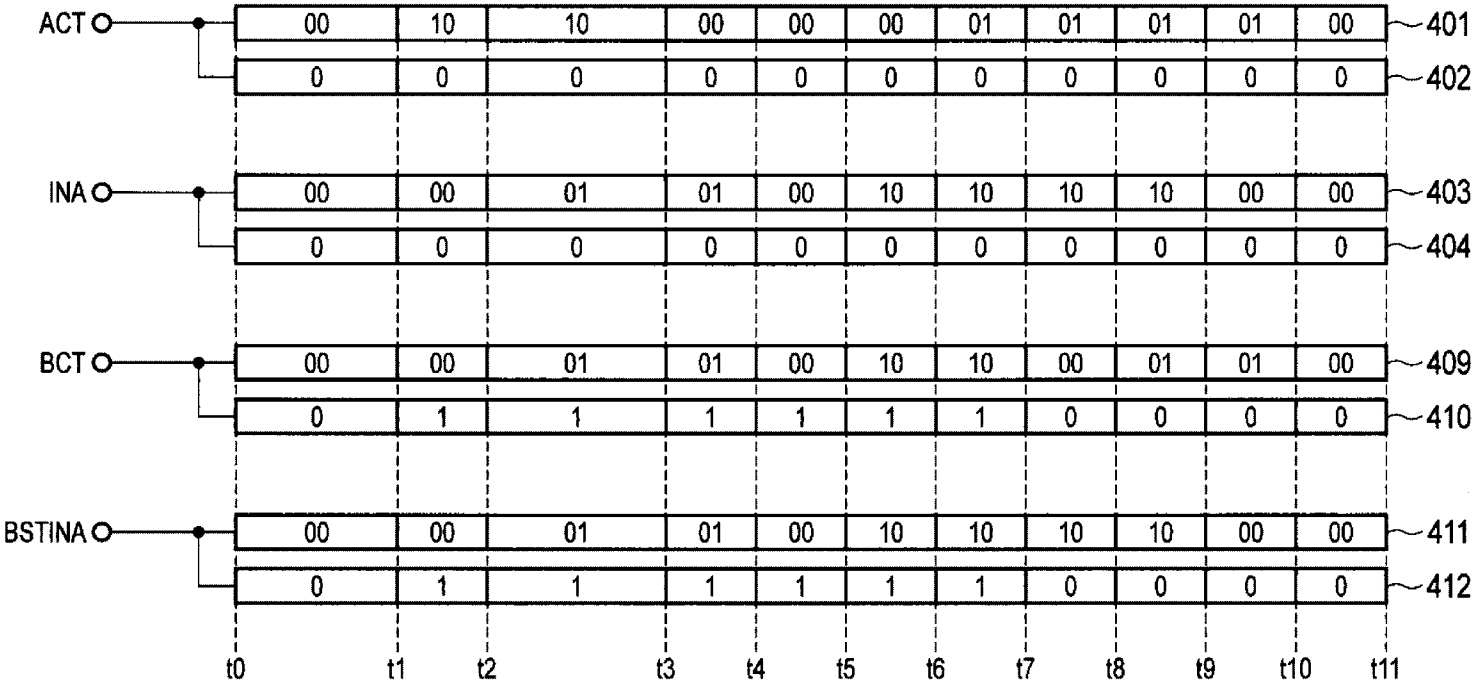
FIG. 15 is a schematic diagram of an example of a code scheme set in a main register among a register group configuring the pattern generator.

FIG. 15 is an example of the potential codes set in the ejection relevant waveform setting register 401, the ejection both-side waveform setting register 403, the auxiliary relevant waveform setting register 409, and the auxiliary both-side waveform setting register 411 and the Hi-Z designation codes set in the Hi-Z setting registers 402, 404, 410, and 412 respectively corresponding to the waveform setting registers 401, 403, 409, and 411. This example corresponds to the application pattern of the driving pulse voltage shown in FIG. 8.

In FIG. 15, a section from time t0 to time t1 is equivalent to the steady state. A section from time t1 to time t4 is equivalent to the draw-in state. A section from time t4 to time t5 is equivalent to the steady state after the draw-in state. A section from time t5 to time t7 is equivalent to the first compressed state. A section from time t7 to time t10 is equivalent to the second compressed state. A section from time t10 to time t11 is equivalent to the steady state after the compressed states.

In a section t0-t1, the potential code of the ejection relevant waveform setting register 401 is "00" and the Hi-Z designation code of the Hi-Z setting register 402 is "0". The potential code and the Hi-Z designation code are output to the logic circuit 300 as an ACT signal.

The logic circuit 300 generates, on the basis of the ACT signal, control signals No. 1SW and No. 7SW for the ejection relevant nozzles 8-1 and 8-7 of the nozzle Nos. 1 and 7. That is, since the potential code is "00" and the Hi-Z designation code is "0", the logic circuit 300 generates the ground signal Gx as the control signals No. 1SW and No. 7SW and outputs the ground signal Gx to the switch circuit 200.

In the switch circuit 200, the ground contact [G] of the control switch SW1 is turned on by the control signal No. 1SW. As a result, the potential of the electrode 4 of the ink chamber 15-1 communicating with the ejection relevant nozzle 8-1 changes to the ground voltage VSS. Similarly, in the switch circuit 200, the ground contact [G] of the control switch SW7 is turned on by the control signal No. 7SW. As a result, the potential of the electrode 4 of the ink chamber 15-7 communicating with the ejection relevant nozzle 8-7 changes to the ground voltage VSS.

In the section t0-t1, the potential code of the ejection both-side waveform setting register 403 is "00" and the Hi-Z designation code of the Hi-Z setting register 404 is "0". The potential code and the Hi-Z designation code are output to the logic circuit 300 as the INA signal.

The logic circuit 300 generates, on the basis of the INA signal, control signals No. 0SW, No. 2SW, No. 6SW, and No. 8SW for the ejection both-side nozzles 8-0, 8-2, 8-6, and 8-8 of the nozzle No. 1, the nozzle No. 2, the nozzle No. 6, and the nozzle No. 8. That is, since the potential code is "00" and the Hi-Z designation code is "0", the logic circuit 300 generates the ground signal Gx as the control signals No. 0SW, No. 2SW, No. 6SW, and No. 8SW and outputs the ground signal Gx to the switch circuit 200.

In the switch circuit 200, the ground contacts [G] of the control switches SW0, SW2, SW6, and SW8 are respectively turned on by the control signals No. 0SW, No. 2SW, No. 6SW, and No. 8SW. As a result, the potentials of the electrodes 4 of the ink chambers 15-0, 15-2, 15-6, and 15-8 communicating with the ejection both-side nozzles 8-0, 8-2, 8-6, and 8-8 change to the ground voltage VSS.

In the section t0-t1, the potential code of the auxiliary relevant waveform setting register 409 is "00" and the Hi-Z designation code of the Hi-Z setting register 410 is "0". The potential code and the Hi-Z designation code are output to the logic circuit 300 as a BST signal. The logic circuit 300 forms, on the basis of the BST signal, a control signal No. 4SW for the auxiliary relevant nozzle 8-4 of the nozzle No. 4. That is, since the potential code is "00" and the Hi-Z designation code is "0", the logic circuit 300 generates the ground signal Gx as the control signal No. 4SW and outputs the ground signal Gx to the switch circuit 200.

In the switch circuit 200, the ground contact [G] of the control switch SW4 is turned on by the control signal No. 4SW. As a result, the potential of the electrode 4 of the ink chamber 15-4 communicating with the auxiliary relevant nozzle 8-4 changes to the ground voltage VSS.

In the section t0-t1, the potential code of the auxiliary both-side waveform setting register 411 is "00" and the Hi-Z designation code of the Hi-Z setting register 412 is "0". The potential code and the Hi-Z designation code are output to the logic circuit 300 as a BSTINA signal. The logic circuit 300 forms, on the basis of the BSTINA signal, control signals No. 3SW and No. 5SW for the auxiliary both-side nozzles 8-3 and 8-5 of the nozzle No. 3 and the nozzle No. 5. That is, since the potential code is "00" and the Hi-Z designation code is "0", the logic circuit 300 generates the ground signal Gx as the control signals No. 3SW and No. 5SW and outputs the ground signal Gx to the switch circuit 200.

In the switch circuit 200, the ground contacts [G] of the control switches SW3 and SW5 are respectively turned on by the control signals No. 3SW and No. 5SW. As a result, the potentials of the electrodes 4 of the ink chambers 15-3 and 15-5 communicating with the auxiliary relevant nozzles 8-3 and 8-5 change to the ground voltage VSS.

Consequently, all the potentials of the electrodes 4 of the ink chambers 15-0 to 15-8 change to the ground voltage VSS. Therefore, partition walls 16-01 to 16-78 partitioning the ink chambers 15-0 to 15-8 are not deformed.

In a section t1-t2, the potential code of the ejection relevant waveform setting register 401 changes to "10". That is, since the potential code is "10" and the Hi-Z designation code is "0", the logic circuit 300 generates the negative voltage pulse signal MVx as the control signal No. 1SW and No. 7SW and outputs the negative voltage pulse signal MVx to the switch circuit 200. In the switch circuit 200, the negative voltage contacts [−] of the control switches SW1 and SW7 are turned on by the control signals No. 1SW and No. 7SW. As a result, the potentials of the electrodes 4 of the ink chambers 15-1 and 15-7 change to the negative voltage −VAA.

In the section t1-t2, both the Hi-Z designation codes of the Hi-Z setting register 410 corresponding to the auxiliary relevant waveform setting register 409 and the Hi-Z setting register 412 corresponding to the auxiliary both-side waveform setting register 411 change to "1". Therefore, the logic circuit 300 generates a high impedance control signal as the control signals No. 3SW, No. 4SW, and No. 5SW and outputs the high impedance control signal to the switch circuit 200. In the switch circuit 200, the control switches SW3, SW4, and SW5 are turned off by the high impedance control signal. As a result, the electrodes 4 of the ink chambers 15-3, 15-4, and 15-5 change to the high impedance state.

In a section t2-t3, all the potential codes of the ejection both-side waveform setting register 403, the auxiliary relevant waveform setting register 409, and the auxiliary both-side waveform setting register 411 change to "01". However, the Hi-Z designation codes of the Hi-Z setting registers 410 and 412 remain at "1". Therefore, the logic circuit 300 generates the positive voltage pulse signal PVx as the control signals No. 0SW, No. 2SW, No. 6SW, and No. 8SW and outputs the positive voltage pulse signal PVx to the switch circuit 200. The control signals No. 3SW, No. 4SW, and No. 5SW remain as the high impedance control signal. In the switch circuit 200, the positive voltage contacts [+] of the control switches SW0, SW2, SW6, and SW8 are turned on by the control signals No. 0SW, No. 2SW, No. 6SW, and No. 8SW. As a result, the potentials of the electrodes 4 of the ink chambers 15-0, 15-2, 15-6, and 15-8 change to the positive voltage +VAA. The electrodes 4 of the ink chambers 15-3, 15-4, and 15-5 continue to be in the high impedance state.

Consequently, the partition walls 16-01 and 16-12 provided between the ink chamber 15-0 and the ink chamber 15-1 and between the ink chamber 15-1 and the ink chamber 15-2 and the partition walls 16-67 and 16-78 provided between the ink chamber 15-6 and the ink chamber 15-7 and between the ink chamber 15-7 and the ink chamber 15-8 are deformed to increase the capacities of the ink chambers 15-1 and 15-7 communicating with the ejection relevant nozzles No. 1 and No. 7. On the other hand, the electrodes 4 of the ink chambers 15-3, 15-4, and 15-5 are in the high impedance state. Both the potentials of the electrodes 4 of the ink chambers 15-2 and 15-6 on both sides of the ink chambers 15-3 to 15-5 are the positive voltage +VAA. Therefore, the positive voltage +VAA is induced to the electrodes 4 of the ink chambers 15-3, 15-4, and 15-5. Therefore, since a potential difference does not occur among the partition walls 16-23, 16-34, 16-45, and 16-56 partitioning spaces of the ink chamber 15-2 to the ink chamber 15-6, the partition walls 16-23, 16-34, 16-45, and 16-56 are not deformed.

In a section t3-t4, the potential code of the ejection relevant waveform setting register 401 changes to "00". Therefore, the logic circuit 300 generates the ground signal Gx as the control signals No. 1SW and No. 7SW and outputs the ground signal Gx to the switch circuit 200. In the switch circuit 200, the ground contacts [G] of the control switches SW1 and SW7 are turned on by the control signals No. 1SW and No. 7SW. As a result, the potentials of the electrodes 4 of the ink chambers 15-1 and 15-7 change to the ground voltage VSS.

In a section t4-t5, all the potential codes of the ejection both-side waveform setting register 403, the auxiliary relevant waveform setting register 409, and the auxiliary both-side waveform setting register 411 change to "00". However, the Hi-Z designation codes of the Hi-Z setting registers 410 and 412 remain at "1". Therefore, the logic circuit 300 generates the ground signal Gx as the control signals No. 0SW, No. 2SW, No. 6SW, and No. 8SW and outputs the ground signal Gx to the switch circuit 200. The control signals No. 3SW, No. 4SW, and No. 5SW remain as the high impedance control signal. In the switch circuit 200, the ground contacts [G] of the control switches SW0, SW2, SW6, and SW8 are turned on by the control signals No. 0SW, No. 2SW, No. 6SW, and No. 8SW. As a result, the potentials of the electrodes 4 of the ink chambers 15-0, 15-2, 15-6, and 15-8 change to the ground voltage VSS. The electrodes 4 of the ink chambers 15-3, 15-4, and 15-5 continue to be in the high impedance state.

Consequently, the partition walls 16-01 and 16-12 provided between the ink chamber 15-0 and the ink chamber 15-1 and between the ink chamber 15-1 and the ink chamber 15-2 and the partition walls 16-67 and 16-78 provided between the ink chamber 15-6 and the ink chamber 15-7 and between the ink chamber 15-7 and the ink chamber 15-8 return to the steady state. At this point, the electrodes 4 of the ink chambers 15-3, 15-4, and 15-5 are in the high impedance state and the potentials of the electrodes 4 of the ink chambers 15-2 and 15-6 on both sides of the ink chambers 15-3 to 15-5 change to the ground voltage VSS. Therefore, the potentials of the electrodes 4 of the ink chambers 15-3, 15-4, and 15-5 also change to the ground voltage VSS. Therefore, the partition walls 16-23, 16-34, 16-45, and 16-56 are not deformed.

In a section t5-t6, all the potential codes of the ejection both-side waveform setting register 403, the auxiliary relevant waveform setting register 409, and the auxiliary both-side waveform setting register 411 change to "10". However, the Hi-Z designation codes of the Hi-Z setting registers 410 and 412 remain at "1". Therefore, the logic circuit 300 generates the negative voltage pulse signal MVx as the control signals No. 0SW, No. 2SW, No. 6SW, and No. 8SW and outputs the negative voltage pulse signal MVx to the switch circuit 200. The control signals No. 3SW, No. 4SW, and No. 5SW remain as the high impedance control signal. In the switch circuit 200, the negative voltage contacts [−] of the control switches SW0, SW2, SW6, and SW8 are turned on by the control signals No. 0SW, No. 2SW, No. 6SW, and No. 8SW. As a result, the potentials of the electrodes 4 of the ink chambers 15-0, 15-2, 15-6, and 15-8 change to the negative voltage −VAA. The electrodes 4 of the ink chambers 15-3, 15-4, and 15-5 continue to be in the high impedance state.

In a section t6-t7, the potential code of the ejection relevant waveform setting register 401 changes to "01". Therefore, the logic circuit 300 generates the positive voltage pulse signal PVx as the control signals No. 1SW and No. 7SW and outputs the positive voltage pulse signal PVx to the switch circuit 200. In the switch circuit 200, the positive voltage contacts [+] of the control switches SW1 and SW7 are turned on by the control signals No. 1SW and No. 7SW. As a result, the potentials of the electrodes 4 of the ink chambers 15-1 and 15-7 change to the positive voltage +VAA.

Consequently, the partition walls 16-01 and 16-12 provided between the ink chamber 15-0 and the ink chamber 15-1 and between the ink chamber 15-1 and the ink chamber 15-2 and the partition walls 16-67 and 16-78 provided between the ink chamber 15-6 and the ink chamber 15-7 and between the ink chamber 15-7 and the ink chamber 15-8 are deformed to reduce the capacities of the ink chambers 15-1 and 15-7 communicating with the ejection relevant nozzles No. 1 and No. 7. At this point, the electrodes 4 of the ink chambers 15-3, 15-4, and 15-5 are in the high impedance state. Both the potentials of the electrodes 4 of the ink chambers 15-2 and 15-6 on both sides of the ink chambers 15-3 to 15-5 are the negative voltage −VAA. Therefore, the negative voltage −VAA is induced to the electrodes 4 of the ink chambers 15-3, 15-4, and 15-5. Therefore, the partition walls 16-23, 16-34, 16-45, and 16-56 are not deformed.

In a section t7 -t8, the potential code of the auxiliary relevant waveform setting register 409 changes to "00". Both the Hi-Z designation codes of the Hi-Z setting register 410 corresponding to the auxiliary relevant waveform setting register 409 and the Hi-Z setting register 412 corresponding to the auxiliary both-side waveform setting register 411 change to "0". Therefore, the logic circuit 300 generates the ground signal Gx as the control signal No. 4SW and outputs the ground signal Gx to the switch circuit 200. The logic circuit 300 generates the negative voltage pulse signal MVx as the control signals No. 3SW and No. 5SW and outputs the negative voltage pulse signal MVx to the switch circuit 200. In the switch circuit 200, the ground contact [G] of the control switch SW4 is turned on by the control signal NO. 4SW. In the switch circuit 200, the negative voltage contacts [−] of the control switches SW3 and SW5 are respectively turned on by the control signals No. 3SW and No. 5SW. As a result, the potential of the electrode 4 of the ink chamber 15-4 changes to the ground voltage VSS. The potentials of the electrodes 4 of the ink chambers 15-3 and 15-5 change to the negative voltage [−].

In a section t8-t9, the potential code of the auxiliary relevant waveform setting register 409 changes to "01". Therefore, the logic circuit 300 generates the positive voltage pulse signal PVx as the control signal No. 4SW and outputs the positive voltage pulse signal PVx to the switch circuit 200. In the switch circuit 200, the positive voltage contact [+] of the control switch SW4 is turned on by the control signal No. 4SW. As a result, the potential of the electrode 4 of the ink chamber 15-4 changes to the positive voltage +VAA.

Consequently, the partition walls 16-34 and 16-45 provided between the ink chamber 15-3 and the ink chamber 15-4 and between the ink chamber 15-4 and the ink chamber 15-5 are deformed to decrease the capacity of the ink chamber 15-4 communicating with the auxiliary relevant nozzle No. 4. According to the deformation, pressure vibration of the ink chamber 15-1 and the ink chamber 15-7 is absorbed.

In a section t9-t10, the potential codes of the ejection both-side waveform setting register 403 and the auxiliary both-side waveform setting register 411 change to "00". Therefore, the logic circuit 300 generates the ground signal Gx as the control signals No. 0SW, No. 2SW, No. 3SW, No. 5SW, No. 6SW, and No. 8SW and outputs the ground signal Gx to the switch circuit 200. In the switch circuit 200, the ground contacts [G] of the control switches SW0, SW2, SW3, SW5, SW6, and SW8 are turned on by the control signals No. 0SW, No. 2SW, No. 3SW, No. 5SW, No. 6SW, and No. 8SW. As a result, the potentials of the electrodes 4 of the ink chambers 15-0, 15-2, 15-3, 15-5, 15-6, and 15-8 change to the ground voltage VSS.

In a section t10-t11, both the potential codes of the ejection relevant waveform setting register 401 and the auxiliary relevant waveform setting register 409 change to "00". Therefore, the logic circuit 300 generates the ground signal Gx as the control signals No. 1SW, No. 4SW, and No. 7SW and outputs the ground signal Gx to the switch circuit 200. In the switch circuit 200, the ground contacts [G] of the control switches SW1, SW4, and SW7 are turned on by the control signals No. 1SW, No. 4SW, and No. 7SW. As a result, the potentials of the electrodes 4 of the ink chambers 15-1, 15-4, and 15-7 change to the ground voltage VSS.

Consequently, all the potentials of the electrodes 4 of the ink chambers 15-0 to 15-8 change to the ground voltage VSS. That is, the head 100 returns to the steady state.

Figure 16:
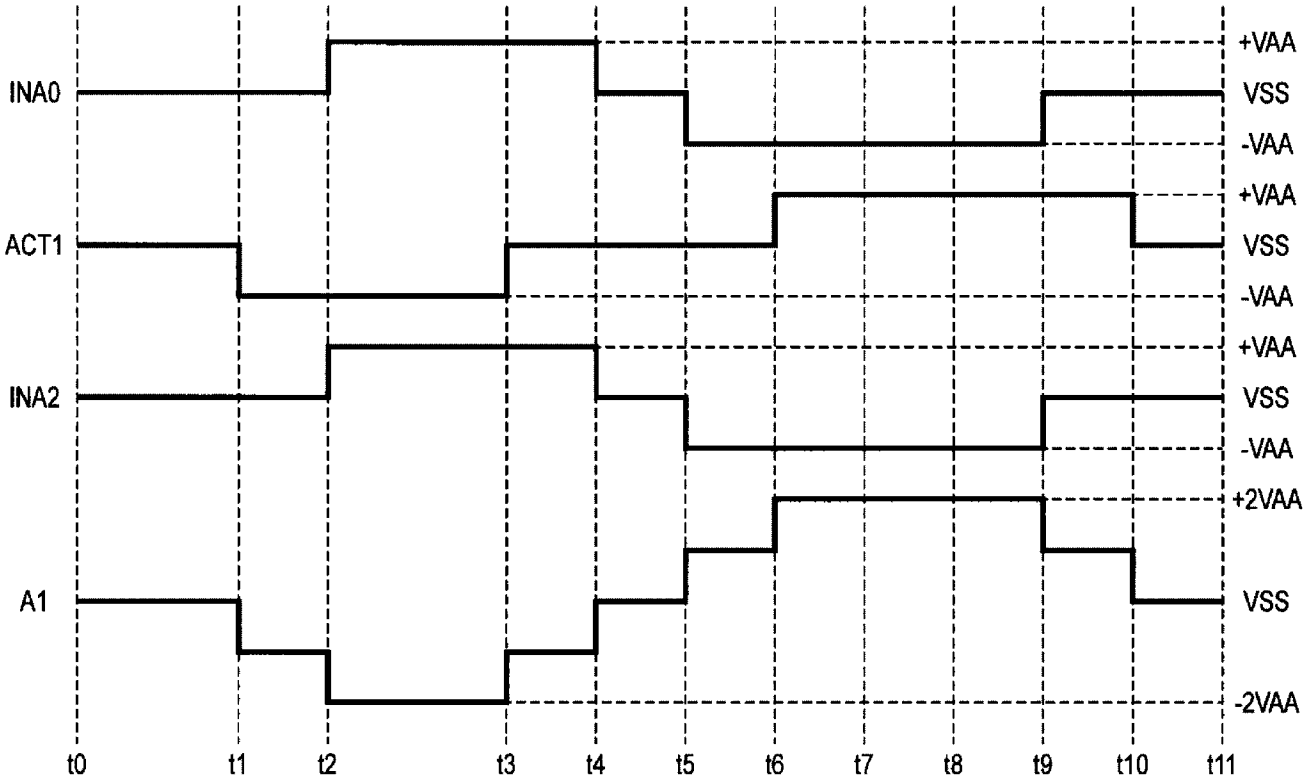
FIG. 16 is a timing chart of driving pulses generated from the code scheme shown in FIG. 15.

In the section t0 to t11, a driving pulse voltage applied to the electrode 4 of the ink chamber 15-0 communicating with the ejection both-side nozzle 8-0 has a waveform INA0 shown in FIG. 16. A driving pulse voltage applied to the electrode 4 of the ink chamber 15-1 communicating with the ejection relevant nozzle 8-1 has a waveform ACT1 shown in FIG. 16. A driving pulse voltage applied to the electrode 4 of the ink chamber 15-2 communicating with the ejection both-side nozzle 8-2 has a waveform INA2 shown in FIG. 16. As a result, a driving pulse voltage acting on the ink chamber 15-1 communicating with the ejection relevant nozzle 8-1 has a waveform A1 shown in FIG. 16.

Figure 17:
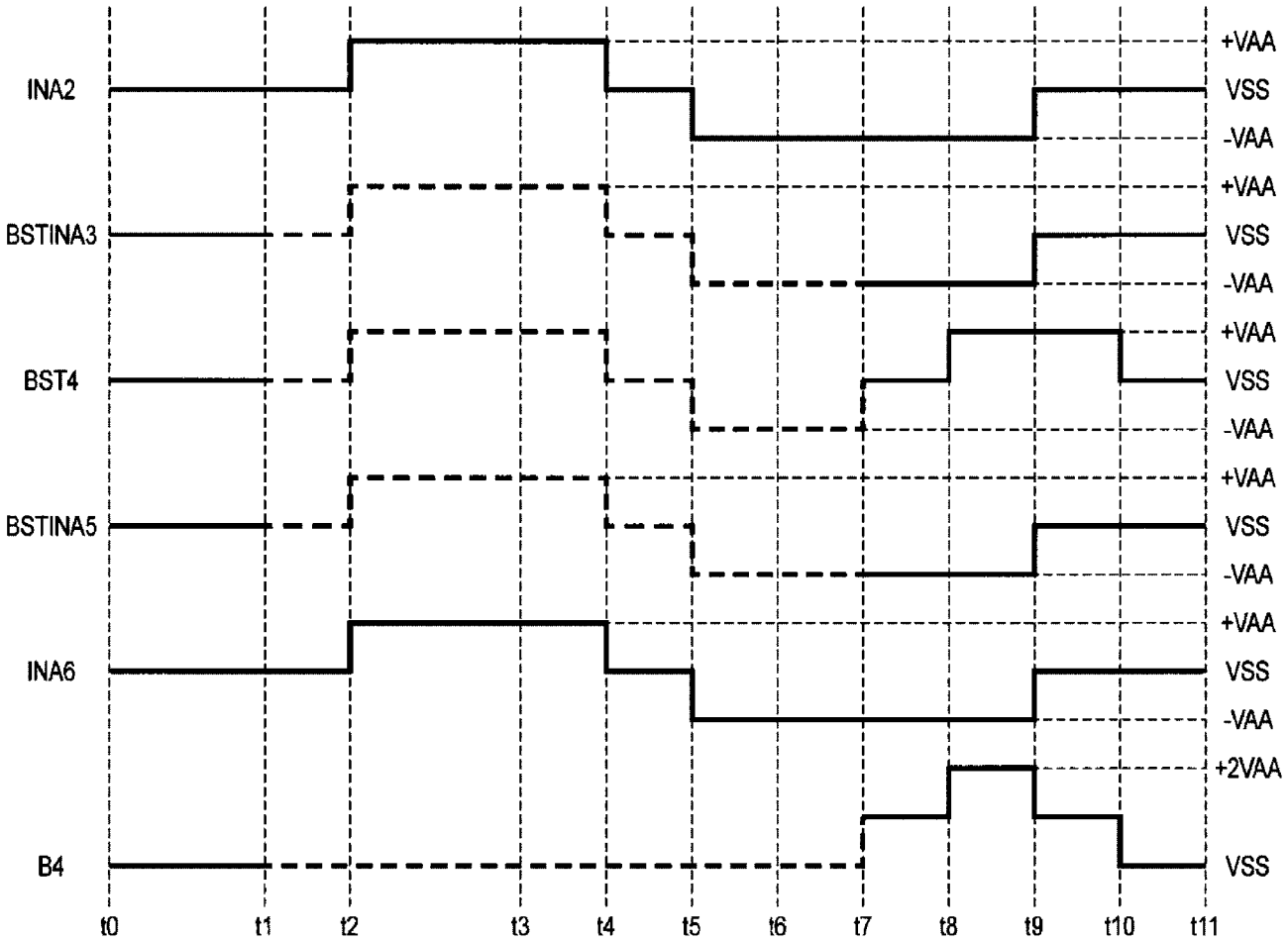
FIG. 17 is a timing chart of driving pulses generated from the code scheme shown in FIG. 15.

In the section t0 to t11, a driving pulse voltage applied to the electrode 4 of the ink chamber 15-2 communicating with the ejection both-side nozzle 8-2 has a waveform INA2 shown in FIG. 17. A driving pulse voltage applied to the electrode 4 of the ink chamber 15-3 communicating with the auxiliary both-side nozzle 8-3 has a waveform BSTINA3 shown in FIG. 17. A driving pulse voltage applied to the electrode 4 of the ink chamber 15-4 communicating with the auxiliary relevant nozzle 8-4 has a waveform BST4 shown in FIG. 17. A driving pulse voltage applied to the electrode 4 of the ink chamber 15-5 communicating with the auxiliary both-side nozzle 8-5 has a waveform BSTINA5 shown in FIG. 17. A driving pulse voltage applied to the electrode 4 of the ink chamber 15-6 communicating with the ejection both-side nozzle 8-6 has a waveform INA6 shown in FIG. 17. In FIG. 17, broken lines indicate that the electrodes 4 are controlled to the high impedance state.

As shown in FIG. 17, in a section t1 to t7, voltages of the same potential are simultaneously respectively applied to the electrodes 4 of the ink chamber 15-2 and the ink chamber 15-6. On the other hand, the electrodes 4 of the ink chambers 15-3, 15-4, and 15-5 are controlled to the high impedance state in the section t1 to t7. Therefore, the voltages of the electrodes 4 of the ink chambers 15-3, 15-4, and 15-5 are induced by voltages applied to the ink chambers 15-2 and 15-6 on both sides of the ink chambers 15-3 to 15-5 and change in the same manner as the voltages applied to the ink chambers 15-2 and 15-6. As a result, a driving pulse voltage acting on the ink chamber 15-4 communicating with the auxiliary relevant nozzle 8-4 has a waveform B4 shown in FIG. 17.

In the section, a driving pulse voltage is not applied to the electrodes 4 of the ink chamber 15-3 to the ink chamber 15-5. Therefore, stray capacitance is not charged or discharged in the ink chamber 15-3 to the ink chamber 15-5. Therefore, it is possible to surely eliminate a noise current and useless power consumption that occur when voltages of the same potential are simultaneously applied to the electrodes 4 of the plurality of ink chambers 15-3 to 15-5 provided side by side.

As explained above, the pattern generator 400 in this embodiment acts as a generator of a driving pulse that can change an electrode to a high impedance state at appropriate timing in order to suppress noise and useless power consumption due to stray capacitance.

Second Embodiment

A pattern generator according to another embodiment is explained. For convenience of explanation, the pattern generator according to the other embodiment is denoted by reference sign "400A".

Figure 18:
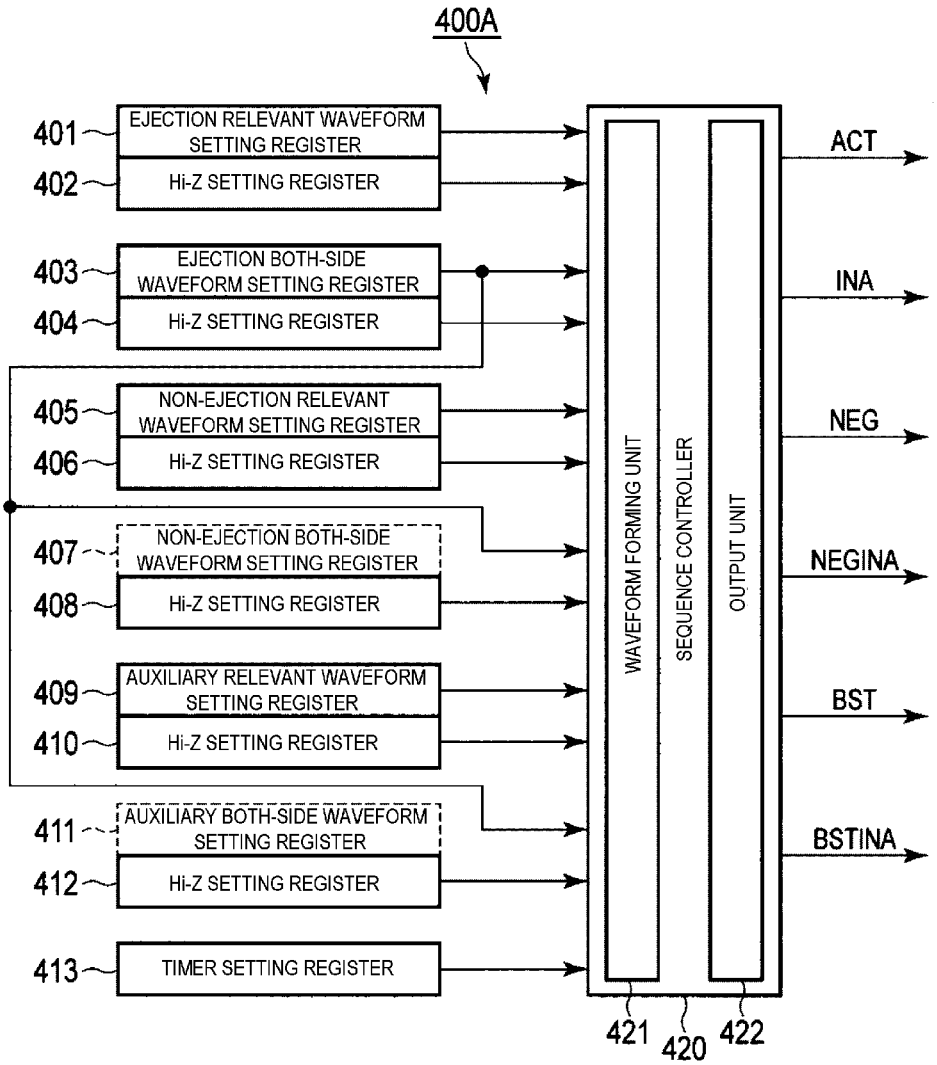
FIG. 18 is a block diagram of a pattern generator according to another embodiment.

FIG. 18 is a block diagram of the pattern generator 400A. Components same as the components of the pattern generator 400 (FIG. 14) in the first embodiment are denoted by the same reference numerals and signs. Detailed explanation of the components is omitted.

As it is evident when FIG. 14 and FIG. 18 are compared, in the pattern generator 400A, the non-ejection both-side waveform setting register 407 and the auxiliary both-side waveform setting register 411 are omitted. The pattern generator 400A uses a potential code output from the ejection both-side waveform setting register 403 not only as setting data of the ejection both-side waveform setting register 403 but also as setting data of the omitted non-ejection both-side waveform setting register 407 and the omitted auxiliary both-side waveform setting register 411. The other components of the pattern generator 400A are the same as the components of the pattern generator 400.

In the first embodiment, as explained with reference to FIG. 6 or 8, in the ink chambers 15-0, 15-2, 15-3, 15-5, 15-6, and 15-8 respectively located on both sides of the ink chambers 15-1, 15-4, and 15-7 set as ink ejection targets, patterns of driving pulse voltages applied to the electrodes 4 are the same. In the ink chambers 15-3 and 15-5 located on both sides of the ink chamber 15-4, which performs the auxiliary operation, patterns of driving pulse voltages applied to the electrodes 4 are the same.

Therefore, as in the pattern generator 400A, the potential code output from the ejection both-side waveform setting register 403 can also be used as the setting data of the non-ejection both-side waveform setting register 407 and the auxiliary both-side waveform setting register 411. The sequence controller 420 forms a NEGINA signal (a non-ejection both-side driving pulse) from two kinds of codes read out from the ejection both-side waveform setting register 403 and the Hi-Z setting register 408. Similarly, the sequence controller 420 forms a BSTINA signal (an auxiliary both-side driving pulse) from two kinds of codes read out from the ejection both-side waveform setting register 403 and the Hi-Z setting register 412.

As explained above, like the pattern generator 400, the pattern generator 400A in this embodiment acts as a generator of a driving pulse that can change an electrode to a high impedance state at appropriate timing in order to suppress noise and useless power consumption due to stray capacitance. Moreover, in the pattern generator 400A, compared with the pattern generator 400, the non-ejection both-side waveform setting register 407 and the auxiliary both-side waveform setting register 411 are omitted. Therefore, it is possible to simplify the configuration of the pattern generator 400A.

In the above explanation, the ejection both-side waveform setting register 403 is left and the non-ejection both-side waveform setting register 407 and the auxiliary both-side waveform setting register 411 are omitted. However, the non-ejection both-side waveform setting register 407 may be left and the ejection both-side waveform setting register 403 and the auxiliary both-side waveform setting register 411 may be omitted. Alternatively, the auxiliary both-side waveform setting register 411 may be left and the ejection both-side waveform setting register 403 and the non-ejection both-side waveform setting register 407 may be omitted. In any case, setting data of the left register only has to be able to be used as setting data of the other omitted registers.

Third Embodiment

Figure 19:
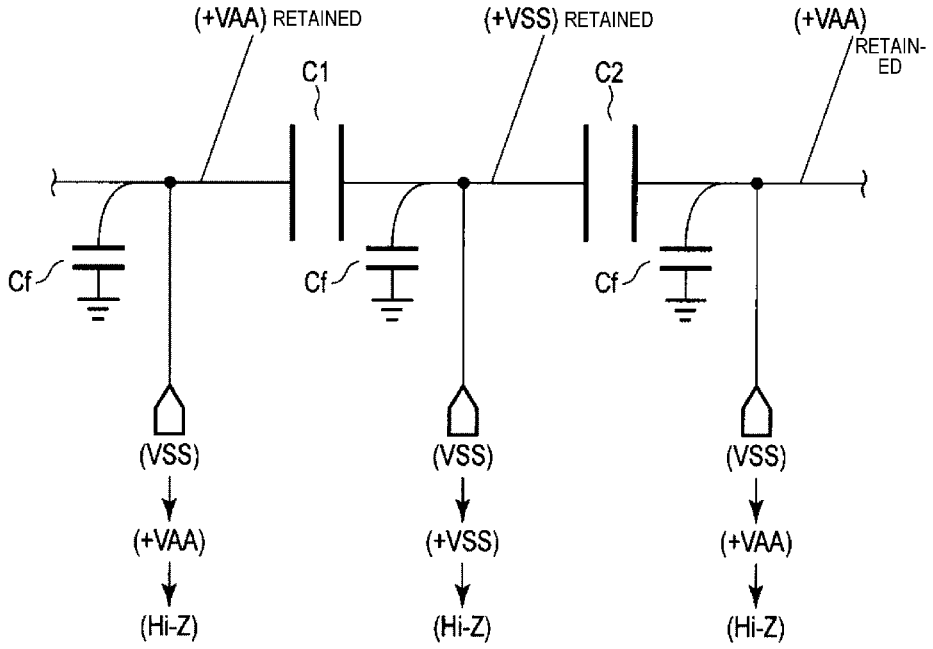
FIG. 19 is a circuit diagram for explaining another physical characteristic of the capacitors.

In the first embodiment, the physical characteristic of the capacitors explained with reference to FIG. 7 is used in order to reduce a noise current and useless power consumption due to stray capacitance. In a third embodiment, a physical characteristic of capacitor explained with reference to FIG. 19 is used to reduce a noise current and useless power consumption due to stray capacitance. Components same as the components in the first embodiment are denoted by the same reference numerals and signs. Detailed explanation of the components is omitted.

FIG. 19 shows a series circuit of capacitors C1 and C2, which is an equivalent circuit of the head 100. In the figure, reference sign Cf represents stray capacitance. In the series circuit, after potential differences are respectively given to the capacitor C1 and the capacitor C2, when both ends of the capacitor C1 and the capacitor C2 are changed to a high impedance state, the capacitors C1 and C2 respectively retain the potential differences immediately preceding the change to the high impedance state. That is, the capacitors C1 and C2 have a physical characteristic that the capacitors C1 and C2 retain the immediately preceding potential differences when the capacitors C1 and C2 change to the high impedance state in a state in which the potential differences are given thereto.

Therefore, in a state in which a potential difference is given to the partition wall 16-(i−1)i partitioning the ink chambers 15-(i−1) and 15-i provided side by side, the driving device changes the electrodes 4 disposed to sandwich the partition wall 16-(i−1)i to the high impedance state. Even in such a case, since the potential difference of the partition wall 16-(i−1) i is retained, an ink ejecting operation is not hindered. It is possible to temporarily stop the application of a driving pulse voltage to the electrodes 4 by changing the electrodes 4 to the high impedance state. Therefore, it is possible to suppress a noise current and useless power consumption due to stray capacitance.

In the third embodiment, it is possible to apply the driving device in the first embodiment simply by changing codes set in the register group of the pattern generator 400. It goes without saying that the pattern generator 400A in the second embodiment can be applied instead of the pattern generator 400.

Figure 20:
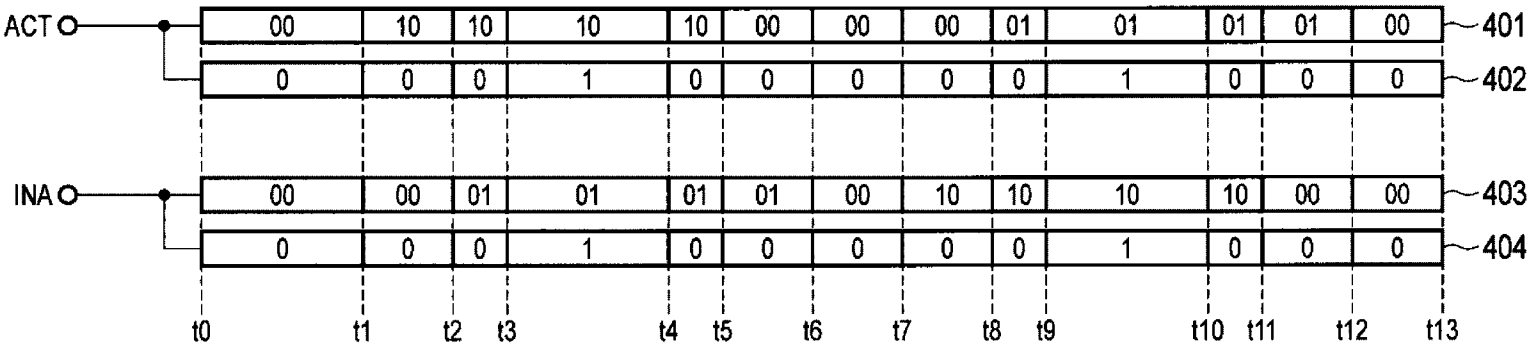
FIG. 20 is a schematic diagram of an example of potential codes set in an ejection relevant waveform setting register and an ejection both-side waveform setting register and Hi-Z designation codes set in Hi-Z setting registers.

FIG. 20 is an example of potential codes set in the ejection relevant waveform setting register 401 and the ejection both-side waveform setting register 403 and Hi-Z designation codes set in the Hi-Z setting registers 402 and 404 respectively corresponding to the ejection relevant waveform setting register 401 and the ejection both-side waveform setting register 403. This example corresponds to the driving pulse voltage pattern shown in FIG. 5.

In FIG. 20, a section from time t0 to time t1 is equivalent to the steady state. A section from time t1 to time t6 is equivalent to the draw-in state. A section from time t6 to time t7 is equivalent to the steady state after the draw-in state. A section from time t7 to time t12 is equivalent to the compressed state. A section from time t12 to time t13 is equivalent to the steady state after the compressed state.

In a section t0-t1, the potential code of the ejection, relevant waveform setting register 401 is "00" and the Hi-Z designation code of the Hi-Z setting register 402 is "0". The potential code of the ejection both-side waveform setting register 403 is also "00" and the Hi-Z designation code of the Hi-Z setting register 404 is also "0". Therefore, the logic circuit 300 generates the ground signal Gx as the control signals No. 1SW, No. 0SW, and No. 2SW for the ejection relevant nozzle 8-1 and the ejection both-side nozzles 8-0 and 8-2 and outputs the ground signal Gx to the switch circuit 200. In the switch circuit 200, all the ground contacts [G] of the control switches SW1, SW0, and SW2 are turned on by the control signals No. 1SW, No. 0SW, and No. 2SW. As a result, all the potentials of the electrode 4 of the ink chamber 15-1 communicating with the ejection relevant nozzle 8-1 and the electrodes 4 of the ink chambers 15-0 and 15-2 communicating with the ejection both-side nozzles 8-0 and 8-2 change to the ground voltage VSS.

In a section t1-t2, the potential code of the ejection relevant waveform setting register 401 changes to "10". Therefore, the logic circuit 300 generates the negative voltage pulse signal MVx as the control signal No. 1SW and outputs the negative voltage pulse signal MVx to the switch circuit 200. In the switch circuit 200, the negative voltage contact [−] of the control switch SW1 is turned on by the control signal No. 1SW. As a result, the potential of the electrode 4 of the ink chamber 15-1 changes to the negative voltage −VAA.

In a section t2-t3, the potential code of the ejection both-side waveform setting register 403 changes to "01". Therefore, the logic circuit 300 generates the positive voltage pulse signal PVx as the control signals No. 0SW and No. 2SW and outputs the positive voltage pulse signal PVx to the switch circuit 200. In the switch circuit 200, the positive contacts [+] of the control switches SW0 and SW2 are turned on by the control signals No. 0SW and No. 2SW. As a result, the potentials of the electrodes 4 of the ink chambers 15-0 and 15-2 change to the positive voltage +VAA.

Consequently, a potential difference occurs between the partition walls 16-01 and 16-12 provided between the ink chamber 15-0 and the ink chamber 15-1 and between the ink chamber 15-1 and the ink chamber 15-2. According to the potential difference, the partition walls 16-01 and 16-12 are deformed to increase the capacity of the ink chamber 15-1 communicating with the ejection relevant nozzle No. 1.

In a section t3-t4, both the Hi-Z designation codes of the Hi-Z setting register 402 corresponding to the ejection relevant waveform setting register 401 and the Hi-Z setting register 404 corresponding to the ejection both-side waveform setting register 403 change to "1". Therefore, the logic circuit 300 generates a high impedance control signal as the control signals No. 0SW, No. 1SW, and No. 2SW and outputs the high impedance control signal to the switch circuit 200. In the switch circuit 200, the control switches SW0, SW1, and SW2 are turned off by the high impedance control signal. As a result, the electrodes 4 of the ink chambers 15-0, 15-1, and 15-2 change to the high impedance state.

However, since the electrodes 4 of the ink chambers 15-0, 15-1, and 15-2 change to the high impedance state in a state in which potential differences are given thereto, the potential differences immediately preceding the change to the high impedance state are retained. That is, the electrode 4 of the ink chamber 15-1 retains the negative voltage −VAA and the electrodes 4 of the ink chambers 15-0 and 15-2 retain the positive voltage +VAA.

In a section t4-t5, all the Hi-Z designation codes of the Hi-Z setting register 402 and the Hi-Z setting register 404 change to "0". Therefore, the logic circuit 300 generates the negative voltage pulse signal MVx as the control signal No. 1SW and outputs the negative voltage pulse signal MVx to the switch circuit 200. The logic circuit 300 generates the positive voltage pulse signal PVx as the control signals No. 0SW and No. 2SW and outputs the positive voltage pulse signal PVx to the switch circuit 200. In the switch circuit 200, the negative voltage contact [−] of the control switch SW1 is turned on by the control signal No. 1SW. However, since the electrode 4 of the ink chamber 15-1 retains the negative voltage −VAA, the potential of the electrode 4 does not change. In the switch circuit 200, the positive voltage contacts [+] of the control switches SW0 and SW2 are also turned on by the control signals No. 0SW and No. 2SW. However, since the electrodes 4 of the ink chambers 15-0 and 15-2 retain the positive voltage +VAA, the potentials of the electrodes 4 do not change either.

In a section t5-t6, the potential code of the ejection relevant waveform setting register 401 changes to "00". Therefore, the logic circuit 300 generates the ground signal Gx as the control signal No. 1SW and outputs the ground signal Gx to the switch circuit 200. In the switch circuit 200, the ground contact [G] of the control switch SW1 is turned on by the control signal No. 1SW. As a result, the potential of the electrode 4 of the ink chamber 15-1 changes to the ground voltage VSS.

In a section t6-t7, the potential code of the ejection both-side waveform setting register 403 changes to "00". Therefore, the logic circuit 300 generates the ground signal Gx as the control signals No. 0SW and No. 2SW and outputs the ground signal Gx to the switch circuit 200. In the switch circuit 200, the ground contacts [G] of the control switches SW0 and SW2 are turned on by the control signals No. 0SW and No. 2SW. As a result, the potentials of the electrodes 4 of the ink chambers 15-0 and 15-2 change to the ground voltage VSS.

Consequently, a potential difference does not occur between the partition walls 16-01 and 16-12 provided between the ink chamber 15-0 and the ink chamber 15-1 and between the ink chamber 15-1 and the ink chamber 15-2. That is, the head 100 returns to the steady state.

In a section t7-t8, the potential code of the ejection both-side waveform setting register 403 changes to "10". Therefore, the logic circuit 300 generates the negative voltage pulse signal MVx as the control signals No. 0SW and No. 2SW and outputs the negative voltage pulse signal MVx to the switch circuit 200. In the switch circuit 200, the negative voltage contacts [−] of the control switches SW0 and SW2 are turned on by the control signals No. 0SW and No. 2SW. As a result, the potentials of the electrodes 4 of the ink chambers 15-0 and 15-2 change to the negative voltage −VAA.

In a section t8-t9, the potential code of the ejection relevant waveform setting register 401 changes to "01". Therefore, the logic circuit 300 generates the positive voltage pulse signal PVx as the control signal No. 1SW and outputs the positive voltage pulse signal PVx to the switch circuit 200. In the switch circuit 200, the positive voltage contact [+] of the control switch SW1 is turned on by the control signal No. 1SW. As a result, the potential of the electrode 4 of the ink chamber 15-1 changes to the positive voltage +VAA.

Consequently, a potential difference occurs between the partition walls 16-01 and 16-12 provided between the ink chamber 15-0 and the ink chamber 15-1 and between the ink chamber 15-1 and the ink chamber 15-2. As a result, the partition walls 16-01 and 16-12 are deformed to reduce the capacity of the ink chamber 15-1 communicating with the ejection relevant nozzle No. 1.

In section t9-t10, both the Hi-Z designation codes of the Hi-Z setting register 402 corresponding to the ejection relevant waveform setting register 401 and the Hi-Z setting register 404 corresponding to the ejection both-side waveform setting register 403 change to "1". Therefore, the logic circuit 300 generates a high impedance control signal as the control signals No. 0SW, No. 1SW, and No. 2SW and outputs the high impedance control signal to the switch circuit 200. In the switch circuit 200, the control switches SW0, SW1, and SW2 are turned off by the high impedance control signal. As a result, the electrodes 4 of the ink chambers 15-0, 15-1, and 15-2 change to the high impedance state.

However, since the electrodes 4 of the ink chambers 15-0, 15-1, and 15-2 change to the high impedance state in a state in which potential differences are given thereto, the potential differences immediately preceding the change to the high impedance state are retained. That is, the electrode 4 of the ink chamber 15-1 retains the positive voltage +VAA and the electrodes 4 of the ink chambers 15-0 and 15-2 retain the negative voltage −VAA.

In a section t10-t11, both the Hi-Z designation codes of the Hi-Z setting register 402 and the Hi-Z setting register 404 change to "0". Therefore, the logic circuit 300 generates the positive voltage pulse signal PVx as the control signal No. 1SW and outputs the positive voltage pulse signal PVx to the switch circuit 200. The logic circuit 300 generates the negative voltage pulse signal MVx as the control signals No. 0SW and No. 2SW and outputs the negative voltage pulse signal MVx to the switch circuit 200. In the switch circuit 200, the positive voltage contact [+] of the control switch SW1 is turned on by the control signal No. 1SW. However, since the electrode 4 of the ink chamber 15-1 retains the positive voltage +VAA, the potential of the electrode 4 does not change. In the switch circuit 200, the negative voltage contacts [−] of the control switches SW0 and SW2 are also turned on by the control signals No. 0SW and No. 2SW. However, since the electrodes 4 of the ink chambers 15-0 and 15-2 retain the negative voltage −VAA, the potentials of the electrodes 4 do not change either.

In a section t11-t12, the potential code of the ejection both-side waveform setting register 403 changes to "00". Therefore, the logic circuit 300 generates the ground signal Gx as the control signals No. 0SW and No. 2SW and outputs the ground signal Gx to the switch circuit 200. In the switch circuit 200, the ground contacts [G] of the control switches SW0 and SW2 are turned on by the control signals No. 0SW and No. 2SW. As a result, the potentials of the electrodes 4 of the ink chambers 15-0 and 15-2 change to the ground voltage VSS.

In a section t12-t13, the potential code of the ejection relevant waveform setting register 401 changes to "00". Therefore, the logic circuit 300 generates the ground signal Gx as the control signal No. 1SW and outputs the ground signal Gx to the switch circuit 200. In the switch circuit 200, the ground contact [G] of the control switch SW1 is turned on by the control signal No. 1SW. As a result, the potential of the electrode 4 of the ink chamber 15-1 changes to the ground voltage VSS.

Consequently, a potential difference does not occur between the partition walls 16-01 and 16-12 provided between the ink chamber 15-0 and the ink chamber 15-1 and between the ink chamber 15-1 and the ink chamber 15-2. That is, the head 100 returns to the steady state.

Figure 21:
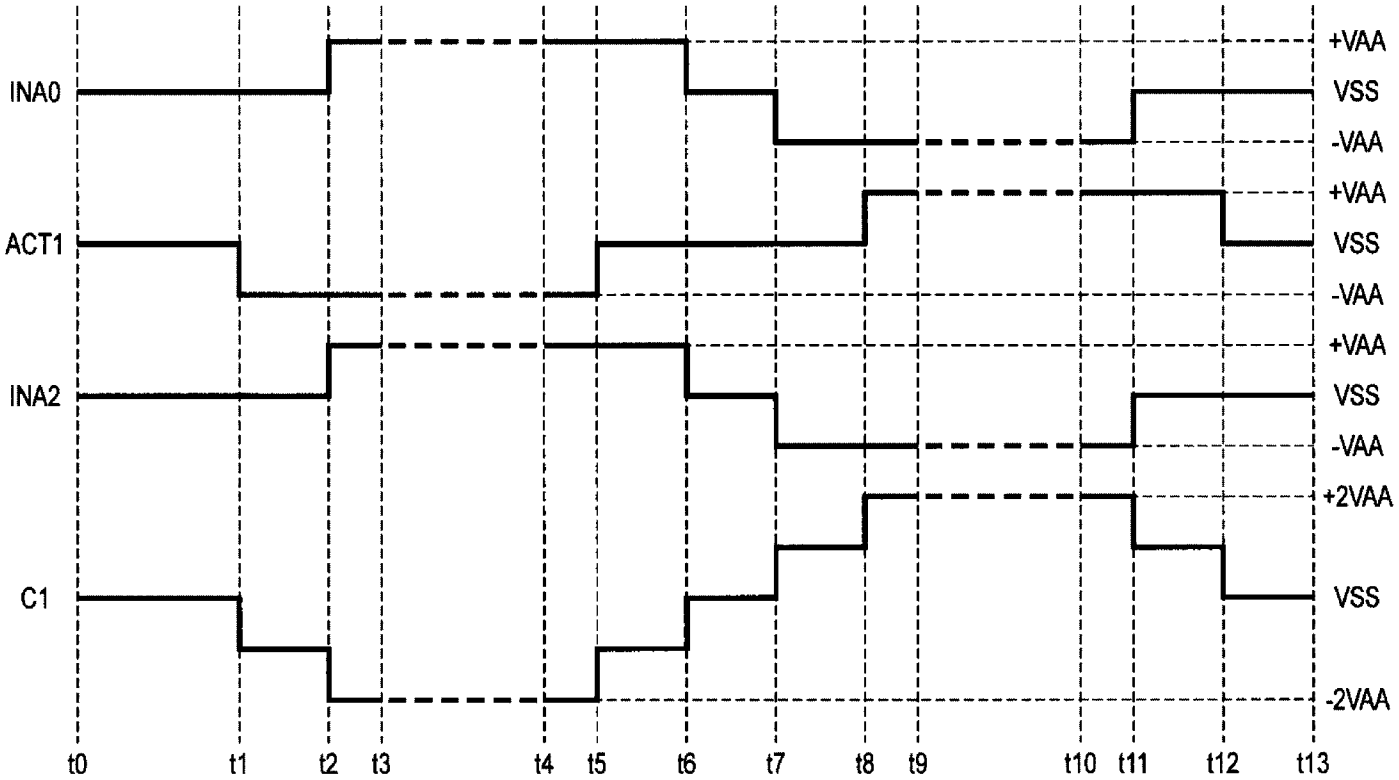
FIG. 21 is a timing chart of driving pulses generated from a code scheme shown in FIG. 20.

In the section t0 to t13, a driving pulse voltage applied to the electrode 4 of the ink chamber 15-0 communicating with the ejection both-side nozzle 8-0 has a waveform INA0 shown in FIG. 21. A driving pulse voltage applied to the electrode 4 of the ink chamber 15-1 communicating with the ejection relevant nozzle 8-1 has a waveform ACT1 shown in FIG. 21. A driving pulse voltage applied to the electrode 4 of the ink chamber 15-2 communicating with the ejection both-side nozzle 8-2 has a waveform INA2 shown in FIG. 21. As a result, a driving pulse voltage acting on the ink chamber 15-1 communicating with the ejection relevant nozzle 8-1 has a waveform C1 shown in FIG. 21. In FIG. 21, broken lines indicate that the electrodes 4 are controlled to the high impedance state.

As shown in FIG. 21, in the section t3-t4, all of the electrodes 4 disposed on both sides of the partition wall 16-01 across the ink chamber 15-0 and the ink chamber 15-1 and the electrodes 4 disposed on both sides of the partition wall 16-12 across the ink chamber 15-1 and the ink chamber 15-2 change to the high impedance state. At this point, the electrodes 4 retain potential differences immediately preceding the change to the high impedance state. That is, the electrodes 4 of the ink chamber 15-0 and the ink chamber 15-2 retain the positive voltage +VAA and the electrode 4 of the ink chamber 15-1 retains the negative voltage −VAA. Therefore, the partition wall 16-01 and the partition wall 16-12 maintain a state in which the partition wall 16-01 and the partition wall 16-12 are deformed in a direction for increasing the capacity of the ink chamber 15-1.

Similarly, in the section t9-t10, all of the electrodes 4 disposed on both sides of the partition wall 16-01 and the electrodes 4 disposed on both sides of the partition wall 16-12 change to the high impedance state. At this point, the electrodes 4 retain potential differences immediately preceding the change to the high impedance state. That is, the electrodes 4 of the ink chamber 15-0 and the ink chamber 15-2 retain the negative voltage −VAA and the electrode 4 of the ink chamber 15-1 retains the positive voltage +VAA. Therefore, the partition wall 16-01 and the partition wall 16-12 maintain a state in which the partition wall 16-01 and the partition wall 16-12 are deformed in a direction for reducing the capacity of the ink chamber 15-1.

In this way, even if the electrodes 4 are temporarily changed to the high impedance state, an ink ejecting operation is not affected. Since a driving pulse voltage is not applied to the electrodes 4 in the high impedance state, while the electrodes 4 are set to the high impedance state, stray capacitance is not charged or discharged in the ink chamber 15-3 to the ink chamber 15-5. Therefore, in this embodiment, as in the first and second embodiments, it is possible to surely eliminate a noise current and useless power consumption that occur when voltages of the same potential are simultaneously applied to the electrodes 4 of the plurality of ink chambers 15-3 to 15-5 provided side by side.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A pulse generator that generates a driving pulse applied to electrodes of an inkjet head in which the electrodes are respectively disposed on wall surfaces of a plurality of ink chambers provided side by side while being partitioned by partition walls made of a piezoelectric material, a potential difference is applied to the electrodes of adjacent two ink chambers to deform the partition wall sandwiched by the electrodes, and ink is ejected from a nozzle communicating with the ink chamber including the deformed partition wall as the wall surface, the pulse generator comprising:

an ejection relevant waveform setting register configured to store setting data of an ejection relevant driving pulse applied to the electrode of the ink chamber communicating with, among the nozzles, an ejection relevant nozzle that ejects the ink;

an ejection both-side waveform setting register configured to store setting data of an ejection both-side driving pulse applied to the electrodes of the ink chambers communicating with, among the nozzles, ejection both-side nozzles arranged on both sides of the ejection relevant nozzle;

a first high impedance setting register provided to correspond to the ejection relevant waveform setting register and configured to store setting data for setting the electrode applied with the ejection relevant driving pulse to a high impedance state for a predetermined period;

a second high impedance setting register provided to correspond to the ejection both-side waveform setting register and configured to store setting data for setting the electrodes applied with the ejection both-side driving pulse to the high impedance state for the predetermined period;

a waveform forming unit configured to form, from the setting data respectively stored in the ejection relevant waveform setting register and the first high impedance setting register, an ejection relevant driving pulse for setting the electrode of the ink chamber communicating with the ejection relevant nozzle to the high impedance state for the predetermined period and form, from the setting data respectively stored in the ejection both-side waveform setting register and the second high impedance setting register, an ejection both-side driving pulse for setting the electrodes of the ink chambers communicating with the ejection both-side nozzles to the high impedance state for the predetermined period; and an output unit configured to output signals of the driving pulses formed by the waveform generating unit to the inkjet head.

2. The generator according to claim 1, wherein the period in which the electrode of the ink chamber communicating with the ejection relevant nozzle and the electrodes of the ink chambers communicating with the ejection both-side nozzles are set in the high impedance state is an arbitrary period in a section in which potential differences that occur between the electrode of the ink chamber communicating with the ejection relevant nozzle and the electrodes of the ink chambers communicating with the ejection both-side nozzles are retained.

3. The generator according to claim 1, further comprising:

a non-ejection relevant waveform setting register configured to store setting data of a non-ejection relevant driving pulse applied to the electrode of the ink chamber communicating with, among the nozzles, a non-ejection relevant nozzle that is driven in a same phase as the ejection relevant nozzle but does not eject the ink;

a non-ejection both-side waveform setting register configured to store setting data of a non-ejection both-side driving pulse applied to the electrodes of the ink chambers communicating with, among the nozzles, non-ejection both-side nozzles arranged on both sides of the non-ejection relevant nozzle;

a third high impedance setting register provided to correspond to the non-ejection relevant waveform setting register and configured to store setting data for setting the electrode applied with the non-ejection relevant driving pulse to the high impedance state for the predetermined time; and a fourth high impedance setting register provided to correspond to the non-ejection both-side waveform setting register and configured to store setting data for setting the electrodes applied with the non-ejection both-side driving pulse to the high impedance state for the predetermined period, wherein the waveform forming unit forms, from the setting data respectively stored in the non-ejection relevant waveform setting register and the third high impedance setting register, a non-ejection relevant driving pulse for setting the electrode of the ink chamber communicating with the non-ejection relevant nozzle to the high impedance state for the predetermined period and forms, from the setting data respectively stored in the non-ejection both-side waveform setting register and the fourth high impedance setting register, a non-ejection both-side driving pulse for setting the electrodes of the ink chambers communicating with the non-ejection both-side nozzles to the high impedance state for the predetermined period.

4. The generator according to claim 3, further comprising:

an auxiliary relevant waveform setting register configured to store setting data of an auxiliary relevant driving pulse applied to the electrode of the ink chamber communicating with, among the nozzles, an auxiliary relevant nozzle that supports an ink ejecting operation by the ejection relevant nozzle;

an auxiliary both-side waveform setting register configured to store setting data of an auxiliary both-side driving pulse applied to the electrodes of the ink chambers communicating with, among the nozzles, auxiliary both-side nozzles arranged on both sides of the auxiliary relevant nozzle;

a fifth high impedance setting register provided to correspond to the auxiliary relevant waveform setting register and configured to store setting data for setting the electrode applied with the auxiliary relevant driving pulse to the high impedance state for the predetermined time; and a sixth high impedance setting register provided to correspond to the auxiliary both-side waveform setting register and configured to store setting data for setting the electrodes applied with the auxiliary both-side driving pulse to the high impedance state for the predetermined time, wherein the waveform forming unit forms, from the setting data respectively stored in the auxiliary relevant waveform setting register and the fifth high impedance setting register, an auxiliary relevant driving pulse for setting the electrode of the ink chamber communicating with the auxiliary relevant nozzle to the high impedance state for the predetermined period and forms, from the setting data respectively stored in the auxiliary both-side waveform setting register and the sixth high impedance setting register, an auxiliary both-side driving pulse for setting the electrodes of the ink chambers communicating with the auxiliary both-side nozzles to the high impedance state for the predetermined period.

5. The generator according to claim 4, wherein any one of the ejection both-side waveform setting register, the non-ejection both-side waveform setting register, and the auxiliary both-side waveform setting register is left and the other registers are omitted, and the setting data of the left register is used as the setting data of the omitted other registers as well.

6. The generator according to claim 5, wherein the period in which the electrodes of the ink chambers communicating with the auxiliary both-side nozzles are set in the high impedance state is an arbitrary period in a section in which a potential of voltages applied to the electrodes of the ink chambers communicating with the auxiliary both-side nozzles and the electrode of the ink chamber communicating with the auxiliary relevant nozzle sandwiched by the auxiliary both-side nozzles is equal to a potential of a voltage applied to the electrode of the ink chamber communicating with the nozzle adjacent to a side of one of the auxiliary both-side nozzles opposite to the auxiliary relevant nozzle and a voltage applied to the electrode of the ink chamber communicating with the nozzle adjacent to a side of the other of the auxiliary both-side nozzles opposite to the auxiliary relevant nozzle.

7. The generator according to claim 5, wherein the period in which the electrodes of the ink chambers communicating with the auxiliary both-side nozzles are set in the high impedance state is an arbitrary period in a section in which a potential of voltages applied to the electrodes of the ink chambers communicating with the auxiliary both-side nozzles and the electrode of the ink chamber communicating with the auxiliary relevant nozzle sandwiched by the auxiliary both-side nozzles is equal to a potential of a voltage applied to the electrode of the ink chamber communicating with the nozzle adjacent to a side of one of the auxiliary both-side nozzles opposite to the auxiliary relevant nozzle and a voltage applied to the electrode of the ink chamber communicating with the nozzle adjacent to a side of the other of the auxiliary both-side nozzles opposite to the auxiliary relevant nozzle.

8. The generator according to claim 4, wherein the period in which the electrodes of the ink chambers communicating with the auxiliary both-side nozzles are set in the high impedance state is an arbitrary period in a section in which a potential of voltages applied to the electrodes of the ink chambers communicating with the auxiliary both-side nozzles and the electrode of the ink chamber communicating with the auxiliary relevant nozzle sandwiched by the auxiliary both-side nozzles is equal to a potential of a voltage applied to the electrode of the ink chamber communicating with the nozzle adjacent to a side of one of the auxiliary both-side nozzles opposite to the auxiliary relevant nozzle and a voltage applied to the electrode of the ink chamber communicating with the nozzle adjacent to a side of the other of the auxiliary both-side nozzles opposite to the auxiliary relevant nozzle.

9. The generator according to claim 4, wherein the period in which the electrodes of the ink chambers communicating with the auxiliary both-side nozzles are set in the high impedance state is an arbitrary period in a section in which a potential of voltages applied to the electrodes of the ink chambers communicating with the auxiliary both-side nozzles and the electrode of the ink chamber communicating with the auxiliary relevant nozzle sandwiched by the auxiliary both-side nozzles is equal to a potential of a voltage applied to the electrode of the ink chamber communicating with the nozzle adjacent to a side of one of the auxiliary both-side nozzles opposite to the auxiliary relevant nozzle and a voltage applied to the electrode of the ink chamber communicating with the nozzle adjacent to a side of the other of the auxiliary both-side nozzles opposite to the auxiliary relevant nozzle.

* * * * *